US009109382B2

(12) United States Patent
Yamaguchi et al.

(10) Patent No.: US 9,109,382 B2
(45) Date of Patent: Aug. 18, 2015

(54) DOOR LOCKING DEVICE

(75) Inventors: Atsushi Yamaguchi, Anjo (JP); Takeshi Tada, Okazaki (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 88 days.

(21) Appl. No.: 14/113,721

(22) PCT Filed: Apr. 13, 2012

(86) PCT No.: PCT/JP2012/060144

§ 371 (c)(1),
(2), (4) Date: Oct. 24, 2013

(87) PCT Pub. No.: WO2012/147540

PCT Pub. Date: Nov. 1, 2012

(65) Prior Publication Data

US 2014/0053618 A1 Feb. 27, 2014

(30) Foreign Application Priority Data

Apr. 28, 2011 (JP) ..... 2011-100907
Apr. 28, 2011 (JP) ..... 2011-100908

(51) Int. Cl.
*E05C 3/04* (2006.01)
*E05B 81/04* (2014.01)
(Continued)

(52) U.S. Cl.
CPC ..... *E05B 81/04* (2013.01); *E05B 49/002* (2013.01); *E05B 81/06* (2013.01); *E05B 81/16* (2013.01);
(Continued)

(58) Field of Classification Search
CPC ..... E05B 81/06; E05B 77/18; E05B 85/06
USPC ..... 292/201, 216, DIG. 23
See application file for complete search history.

(56) References Cited

U.S. PATENT DOCUMENTS 5,971,449 A * 10/1999 Rogers et al. ..... 292/216
6,017,067 A * 1/2000 Yoneyama et al. ..... 292/216
(Continued)

FOREIGN PATENT DOCUMENTS

JP 2001-152713 A 6/2001
JP 2004-169416 A 6/2004
(Continued)

OTHER PUBLICATIONS

Japanese Office Action (Notification of Reasons for Refusal) dated Aug. 27, 2014, issued by the Japanese Patent Office in corresponding Japanese Patent Application No. JP2011-100908A with an English translation of the Japanese Office Action (5 pgs).
(Continued)

*Primary Examiner* — Mark Williams
(74) *Attorney, Agent, or Firm* — Buchanan Ingersoll & Rooney PC

(57) ABSTRACT

A door locking device which is reduced in size relative to a conventional device includes a key operation transmission link, which transmits a key operation force relative to a key cylinder to a relay lever corresponding to "a lock switch member", and which is arranged to rotate about a common rotation axis shared with the relay lever. In addition, a rotation space for first and second movable contact portions fits within a circular-shaped area around the common rotation axis because a first fan-shaped protruding portion including the first movable contact portion for transmitting a force to the key operation transmission link and the relay lever and a second fan-shaped protruding portion including the second movable contact portion for transmitting the force to the key operation transmission link and the relay lever are arranged around the common rotation axis.

6 Claims, 28 Drawing Sheets

(51) Int. Cl.

| | |
|---|---|
| ***E05B 81/06*** | (2014.01) |
| ***E05B 81/16*** | (2014.01) |
| ***E05B 81/34*** | (2014.01) |
| ***E05B 83/36*** | (2014.01) |
| ***E05B 85/06*** | (2014.01) |
| ***E05B 81/42*** | (2014.01) |
| ***E05B 49/00*** | (2006.01) |
| *E05B 77/18* | (2014.01) |
| *E05B 81/74* | (2014.01) |

(52) U.S. Cl.
CPC ..... *E05B 81/34* (2013.01); *E05B 81/42* (2013.01); *E05B 83/36* (2013.01); *E05B 85/06* (2013.01); *E05B 77/18* (2013.01); *E05B 81/74* (2013.01)

(56) References Cited

U.S. PATENT DOCUMENTS

| | | | | |
|---|---|---|---|---|
| 6,024,389 | A * | 2/2000 | Arabia et al. | 292/216 |
| 6,079,757 | A * | 6/2000 | Aubry | 292/201 |
| 7,568,741 | B2 * | 8/2009 | Odahara | 292/216 |
| 8,814,226 | B2 * | 8/2014 | Akizuki et al. | 292/196 |
| 2008/0121062 | A1 | 5/2008 | Yoda | |
| 2011/0254287 | A1 | 10/2011 | Akizuki et al. | |

FOREIGN PATENT DOCUMENTS

| | | | |
|---|---|---|---|
| JP | 2005-307446 | A | 11/2005 |
| JP | 2007-138453 | A | 6/2007 |
| JP | 2007-314956 | A | 12/2007 |
| JP | 2008-14094 | A | 1/2008 |
| JP | 2008-214935 | A | 9/2008 |

OTHER PUBLICATIONS

Japanese Office Action (Notification of Reasons for Refusal) dated Aug. 27, 2014, issued by the Japanese Patent Office in corresponding Japanese Patent Application No. JP2011-100907A with an English translation of the Japanese Office Action (6 pgs).
International Search Report (PCT/ISA/210) mailed on May 22, 2012, by the Japanese Patent Office as the International Searching Authority for International Application No. PCT/JP2012/060144.
Written Opinion (PCT/ISA/237) mailed on May 22, 2012, by the Japanese Patent Office as the International Searching Authority for International Application No. PCT/JP2012/060144.
Japanese Notification of Reasons for Refusal issued Apr. 1, 2015, by the Japan Patent Office, in corresponding Japanese Patent Application No. 2011-100908 with English translation. (6 pages).

* cited by examiner

DOOR LOCKING DEVICE

TECHNICAL FIELD

This invention relates to a door locking device which is adapted to be built in a door of a vehicle, and which is adapted to be able to lock and unlock the door by means of a key operation relative to a key cylinder provided at the door.

BACKGROUND ART

A conventional door locking device shown in FIG. 24 is configured to rotate a lock switch member 2 to a lock position and to an unlock position by means of a power of a motor, and lock and unlock a door. According to this door locking device, a key operation transmission member 3, which is formed in a fan shape and rotates in response to a key operation of a key cylinder (not shown in the drawing) provided at the door, is provided at a lateral side relative to the lock switch member 2. Then, a key operating force is transmitted from the key operation transmission member 3 to the lock switch member 2 so that the lock switch member 2 is switched to the lock position and to the unlock position also by means of the key operation of the key cylinder. In addition, in order that the key cylinder does not move from a neutral position without the key operation, it is configured that a force is not transmitted from the lock switch member 2 to the key operation transmission member 3. Specifically, a distal end portion of an engagement arm 5, which extends from the lock switch member 2, is received dated between a pair of contact portion protruding portions 4, 4 which are included in the key operation transmission member 3. Then, in a case where the key operation transmission member 3 is rotated to a key lock position and to a key unlock position by the key operation operated relative to the key cylinder, the engagement arm 5 is pushed by either of the contact portion protruding portions 4, and the lock switch member 2 rotates to the lock position and to the unlock position. On the other hand, even when the lock switch member 2 rotates to the lock position and to the unlock position in a state where the key operation transmission member 3 is positioned at the neutral position, the engagement arm 5 does not push the contact portion protruding portions 4, 4 but rotates between the contact portion protruding portions 4, 4, and the key operation transmission member 3 is configured to be kept at the neutral position (for example, see Patent Document 1).

DOCUMENT OF PRIOR ART

Patent Document

Patent Document 1: JP2007-138453A (FIG. 1, FIG. 8, paragraphs [0067] to [0069])

OVERVIEW OF INVENTION

Problem to be Solved by Invention

However, according to the above-described door locking device, a large space needs to be assured, where a rotation space for each of the key operation transmission member 3 and the engagement arm 5 is added to an installation space of the lock switch member 2 and the key operation transmission member 3 which are arranged side-by-side. Therefore, the door locking device is prevented from being reduced in size.

This invention is made in consideration of the above-described circumstance and a purpose of this invention is to provide a door locking device which is able to be reduced in size relative to a conventional device.

Means for Solving Problem

The invention of claim 1, which is made in order to achieve the above-described purpose, is a door locking device including a lock switch member adapted to be built in a door of a vehicle, and adapted to rotate between a lock position locking the door and an unlock position unlocking the door when receiving a force from a lock operation portion provided at a vehicle interior side of the door or from an electric drive source built in the door, a key operation transmission member provided to be rotatable about a common rotation axis which is shared with the lock switch member, the key operation transmission member adapted to rotate between a key lock position and a key unlock position when receiving a key operation force relative to a key cylinder provided at the door, a first movable contact portion rotating integrally with one of the lock switch member and the key operation transmission member, and arranged at a part around the common rotation axis thereof, a second movable contact portion rotating integrally with the other one of the lock switch member and the key operation transmission member, and arranged at a part around the common rotation axis thereof, the part being different from an arrangement position of the first movable contact portion, the second movable contact portion transmitting the key operation force between the second movable contact portion and the first movable contact portion in a case where the key operation transmission member is rotated to the key lock position, so that the lock switch member is rotated to the lock position in a cooperating manner, the second movable contact portion transmitting the key operation force between the second movable contact portion and the first movable contact portion in a case where the key operation transmission member is rotated to the key unlock position, so that the lock switch member is rotated to the unlock position in the cooperating manner, and a rotation clearance provided between the first movable contact portion and the second movable contact portion around the common rotation axis, the rotation clearance causing only one of the first movable contact portion and the second movable contact portion to rotate together with the lock switch member and restricting the key operation transmission member from rotating in the cooperating manner in a case where the lock switch member is rotated to the lock position and to the unlock position in a state where the key operation transmission member is positioned at a neutral position which is positioned intermediately between the key lock position and the key unlock position.

The invention of claim 2 is the door locking device described in claim 1, which includes the first movable contact portion provided as a pair at two positions around the common rotation axis, and the second movable contact portion provided as a pair at two positions around the common rotation axis between the pair of first movable contact portions.

The invention of claim 3 is the door locking device described in claim 2, which includes a pair of first fan-shaped protruding portions rotating integrally with one of the lock switch member and the key operation transmission member, and provided at two positions which are away from each other by 180 degrees around the common rotation axis thereof, a pair of second fan-shaped protruding portions rotating integrally with the other one of the lock switch member and the key operation transmission member, the pair of second fan-shaped protruding portions being provided at two positions which are away from each other by 180 degrees around the common rotation axis thereof and being arranged alternately with the first fan-shaped protruding portions around the common rotation axis, the pair of first movable contact portions serving as both lateral surfaces of each of the first fan-shaped protruding portions, and the pair of second movable contact portions serving as both lateral surfaces of each of the second fan-shaped protruding portions.

The invention of claim 4 is the door locking device described in any one of claims 1 to 3, which includes a latch unit adapted to be able to keep the door in a state where the door is closed relative to the vehicle, an open link adapted to transfer to an unlock position where an engagement relative to the latch unit is possible and to a lock position where the engagement relative to the latch unit is impossible, the open link adapted to lock the door at the lock position, and on the other hand, to unlock the door at the unlock position, an active lever defining the lock position and the unlock position of the open link, a relay lever rotating about a rotation axis which is different from the active lever and serving as the lock switch member; and a lever connecting member connecting the active lever and the relay lever to each other so that the active lever and the relay lever are movable in a cooperating manner with each other.

The invention of claim 5 is the door locking device described in any one of claims 1 to 3, which includes a latch unit adapted to be able to keep the door in a state where the door is closed relative to the vehicle, an open link adapted to transfer to an unlock position where an engagement relative to the latch unit is possible and to a lock position where the engagement relative to the latch unit is impossible, the open link adapted to lock the door at the lock position, and on the other hand, to unlock the door at the unlock position, an active lever defining the lock position and the unlock position of the open link, a relay lever rotating about a rotation axis which is different from the active lever and serving as the lock switch member, a long hole provided at one of the active lever and the relay lever, and a pin provided at the other one of the active lever and the relay lever, the pin engaging with the long hole and enabling the active lever and the relay lever to move in a cooperating manner with each other.

The invention of claim 6 is the door locking device described in any one of claims 1 to 3, which includes a latch unit adapted to be able to keep the door in a state where the door is closed relative to the vehicle, an open link adapted to transfer to an unlock position where an engagement relative to the latch unit is possible and to a lock position where the engagement relative to the latch unit is impossible, the open link adapted to lock the door at the lock position, and on the other hand, to unlock the door at the unlock position, and an active lever defining the lock position and the unlock position of the open link and serving as the lock switch member.

The invention of claim 7 is the door locking device described in any one of claims 4 to 6, which includes the active lever adapted in a manner that a wire-shaped member operating integrally with the lock operation portion is connected to the active lever, the active lever rotating when receiving an operation force relative to the lock operation portion, rotating when receiving a power from a motor serving as the electric drive source, and moving between a lock position locking the door and an unlock position unlocking the door.

The invention of claim 8 is a door locking device which includes a lock switch member adapted to be built in a door of a vehicle, and adapted to rotate between a lock position locking the door and an unlock position unlocking the door when receiving a force from a lock operation portion provided at a vehicle interior side of the door or from an electric drive source built in the door, a key operation transmission member adapted to rotate between a key lock position and a key unlock position when receiving a key operation force relative to a key cylinder provided at the door, the key operation transmission member transmitting the key operation force to the lock switch member so that, in a case where the key operation transmission member rotates to the key lock position, the lock switch member is rotated to the lock position in a cooperating manner, whereas, in a case where the key operation transmission member rotates to the key unlock position, the lock switch member is rotated to the unlock position in the cooperating manner, the key operation transmission member arranged to rotate about a common rotation axis which is shared with the lock switch member, a first movable contact portion provided at one of the lock switch member and the key operation transmission member, and arranged around the common rotation axis, and a second movable contact portion provided at the other one of the lock switch member and the key operation transmission member, and arranged around the common rotation axis in a manner that a predetermined rotation clearance is interposed relative to the first movable contact portion, wherein the first movable contact portion rotates relative to the second movable contact portion in a range of the rotation clearance between the first movable contact portion and the second movable contact portion, and a transmission of a force from the lock switch member to the key operation transmission member is interrupted even in a case where the lock switch member is rotated to any one of the lock position and the unlock position in a state where the key operation transmission member is positioned at a neutral position which is positioned intermediately between the key lock position and the key unlock position, whereas the second movable contact portion rotates relative to the first movable contact portion beyond the rotation clearance between the second movable contact portion and the first movable contact portion and thus the key operation force is transmitted from the key operation transmission member to the lock switch member in a case where the key operation transmission member is rotated from the neutral position to the key lock position and to the key unlock position.

Effects of the Invention

According to the door locking device related to this invention, the key operation transmission member, which transmits the key operation force on the key cylinder to the lock switch member, is arranged so as to rotate about the common rotation axis that is shared with the lock switch member, and therefore a reduction in size of the door locking device is enabled in comparison with a conventional device at which the lock switch member and the key operation transmission member are arranged so as to rotate about different rotation axes from each other. In addition, the first movable contact portions and the second movable contact portions which are for transmitting the force to the key operation transmission member and the lock switch member are arranged around the common rotation axis which is shared with the key operation transmission member and the lock switch member, and thus a rotation space for the first and second movable contact portions fits within a circular-shaped area around the common rotation axis. Also in this respect, the reduction in the size of the door locking device is enabled.

Specifically, for example, a configuration may include the latch unit adapted to be able to keep the door in the state where the door is closed relative to the vehicle, the open link which is adapted to transfer to the unlock position where the engagement relative to the latch unit is possible and to the lock position where the engagement relative to the latch unit is impossible, and is adapted to lock the door at the lock position, whereas the open link is adapted to unlock the door at the unlock position, the active lever defining the lock position and the unlock position of the open link, and the active lever may be, as the above-described lock switch member, connected to the key operation transmission member (the invention of claim 6).

Further, in addition to the latch unit, the open link and the active lever which are described above, the configuration may include the relay lever rotating about the rotation axis which is different from the active lever, and the lever connecting member connecting the active lever and the relay lever to each other so that the active lever and the relay lever are movable in the cooperating manner with each other, and the relay lever may be, as the above-described lock switch member, connected to the key operation transmission member (the invention of claim 4).

Further, in addition to the latch unit, the open link, the active lever and the relay lever which are described above, the configuration may include the long hole provided at one of the active lever and the relay lever, and the pin which is provided at the other one of the active lever and the relay lever, engages with the long hole and enables the active lever and the relay lever to move in the cooperating manner with each other, and the relay lever may be, as the lock switch member, connected to the key operation transmission member (the invention of claim 5).

In addition, according to the configuration of claim 3, the pair of first movable contact portions each arranged at one of the lateral surfaces of each of the pair of the first fan-shaped protruding portions is in surface contact with the pair of second movable contact portions each arranged at one of the lateral surfaces of each of the pair of the second fan-shaped protruding portions in a case where the key operation transmission member is rotated to the key lock position, and the pair of first movable contact portions each arranged at the other one of the lateral surfaces of each of the pair of the first fan-shaped protruding portions is in surface contact with the pair of second movable contact portions each arranged at the other one of the lateral surfaces of each of the pair of the second fan-shaped protruding portions in a case where the key operation transmission member is rotated to the key unlock position. Thus, according to this invention, the pair of first movable contact portions and the pair of second movable contact portions are in surface contact with each other in order to transmit the key operation force from the key operation transmission member to the lock switch member, and therefore a load applied to the first and second movable contact portions is reduced and durability improves compared to a device at which only a single first movable contact portion and a single second movable contact portion are in surface contact with each other or a device at which the first and second movable contact portions are in point-contact or in line-contact with each other.

MODE FOR CARRYING OUT THE INVENTION

First Embodiment

Figure 1:
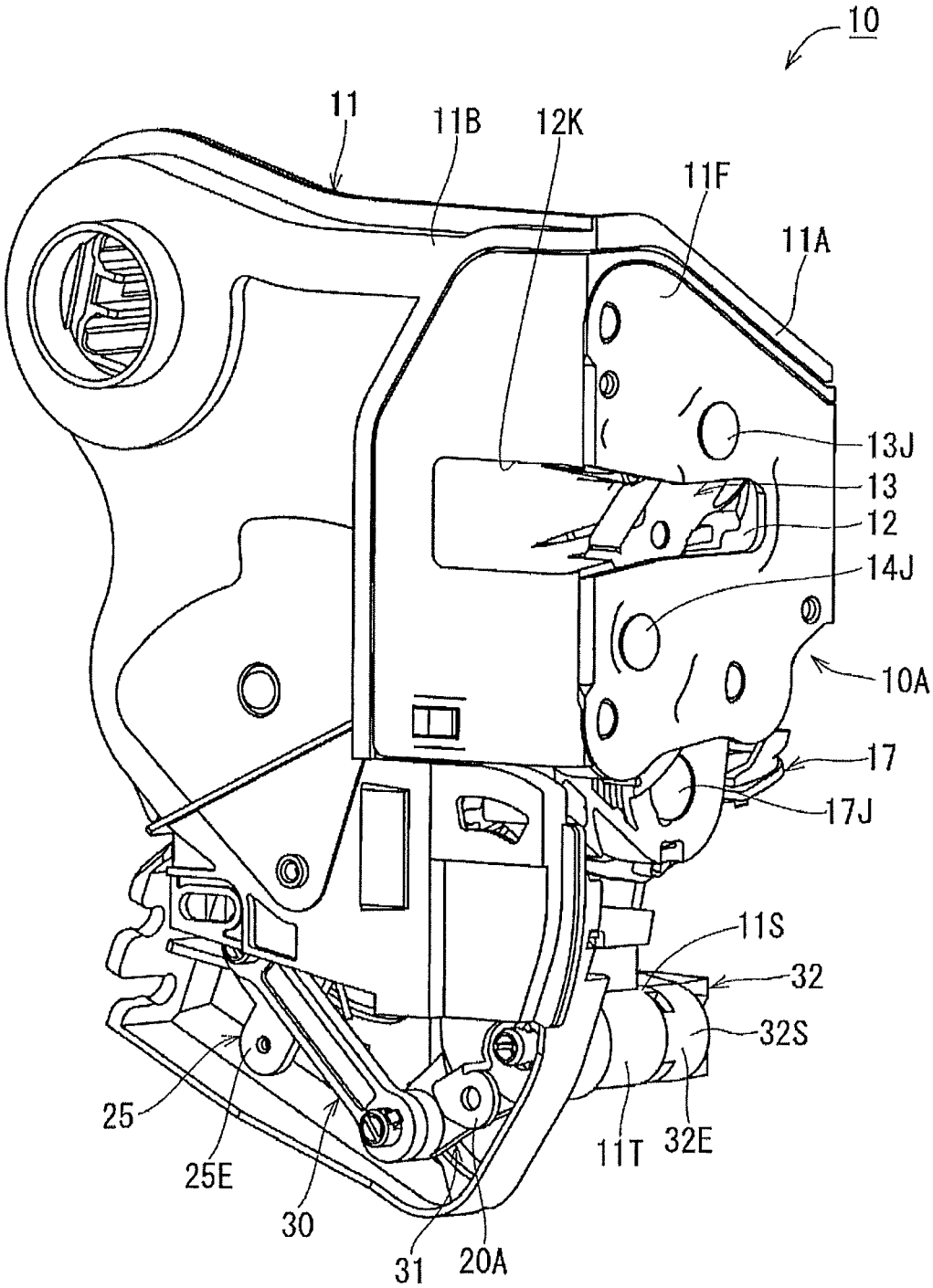
FIG. 1 Perspective view of a door locking device according to a first embodiment of this invention FIG. 2A Perspective view of a part of a vehicle FIG. 2B Perspective view of a vehicle interior side of a door of the vehicle FIG. 3A Lateral view of the door locking device in an unlatched state FIG. 3B Lateral view of the door locking device in a fully-latched state FIG. 4A Lateral view of a lift lever, an open link and the like FIG. 4B Lateral view of the lift lever, the open link and the like FIG. 5A Lateral view of the lift lever, the open link and the like FIG. 5B Lateral view of the lift lever, the open link and the like FIG. 6 Perspective view of a vehicle interior side of the door locking device FIG. 7 Perspective view of a vehicle exterior side of the door locking device FIG. 8 Front view of the door locking device FIG. 9 Enlarged front view of a part of the door locking device in an unlocked state FIG. 10 Enlarged front view of the part of the door locking device in the unlocked state FIG. 11 Enlarged front view of the part of the door locking device in a locked state FIG. 12 Perspective view of a key operation transmission link and a relay lever FIG. 13 Enlarged front view of a part of a door locking device of a second embodiment FIG. 14 Enlarged front view of a part of the door locking device in the unlocked state FIG. 15 Enlarged front view of the part of the door locking device in the locked state FIG. 16 Front view of a door locking device of a third embodiment FIG. 17 Front view of the door locking device in a state where an outside open lever is positioned at an operation position in the unlocked state FIG. 18 Front view of the door locking device in a state where the outside open lever is positioned at a non-operation position in the locked state FIG. 19 Front view of the door locking device in a state where the outside open lever is positioned at the operation position in the locked state FIG. 20 Perspective view of a lateral surface side of the door locking device FIG. 21 Exploded perspective view of the door locking device FIG. 22 Exploded perspective view of the door locking device FIG. 23 Perspective view of the key operation transmission link and an active lever FIG. 24 Front view of main components of a conventional door locking device

A first embodiment of this invention will be described hereunder on the basis of FIG. 1 to FIG. 12. As shown in FIG. 1, a door locking device 10 of this embodiment is formed, for example, by rotatably supporting plural components at a support body 11 which is bent at substantially right angles. Then, for example, a first outer surface 11A of the support body 11 which is at one side relative to a bent portion is applied to and fixed to an end portion wall 101A of a pivot-type door 101 from an inner surface, the door 101 is arranged at a right lateral side of a vehicle 100 (see FIG. 2A), and the end portion wall 101A is at an opposite side to a pivot center of the door 101.

At the first outer surface 11A of the support body 11, a striker receiving groove 12 extending in a horizontal direction is opened. A striker receiving opening 12K, which is at one end of the striker receiving groove 12, is opened at a second outer surface 11B of the support body 11 which is at an opposite side to the first outer surface 11A with respect to the bent portion. Then, the striker receiving groove 12 is exposed outside the door 101 via a cut-out hole 101B (see FIG. 2A and FIG. 2B) formed at the door 101, and a striker 15 (see FIG. 2A) provided at an inner surface of a door frame 100W of the vehicle 100 is configured to enter inside the striker receiving groove 12 from the striker receiving opening 12K in a case where the door 101 is closed.

Figure 3A:
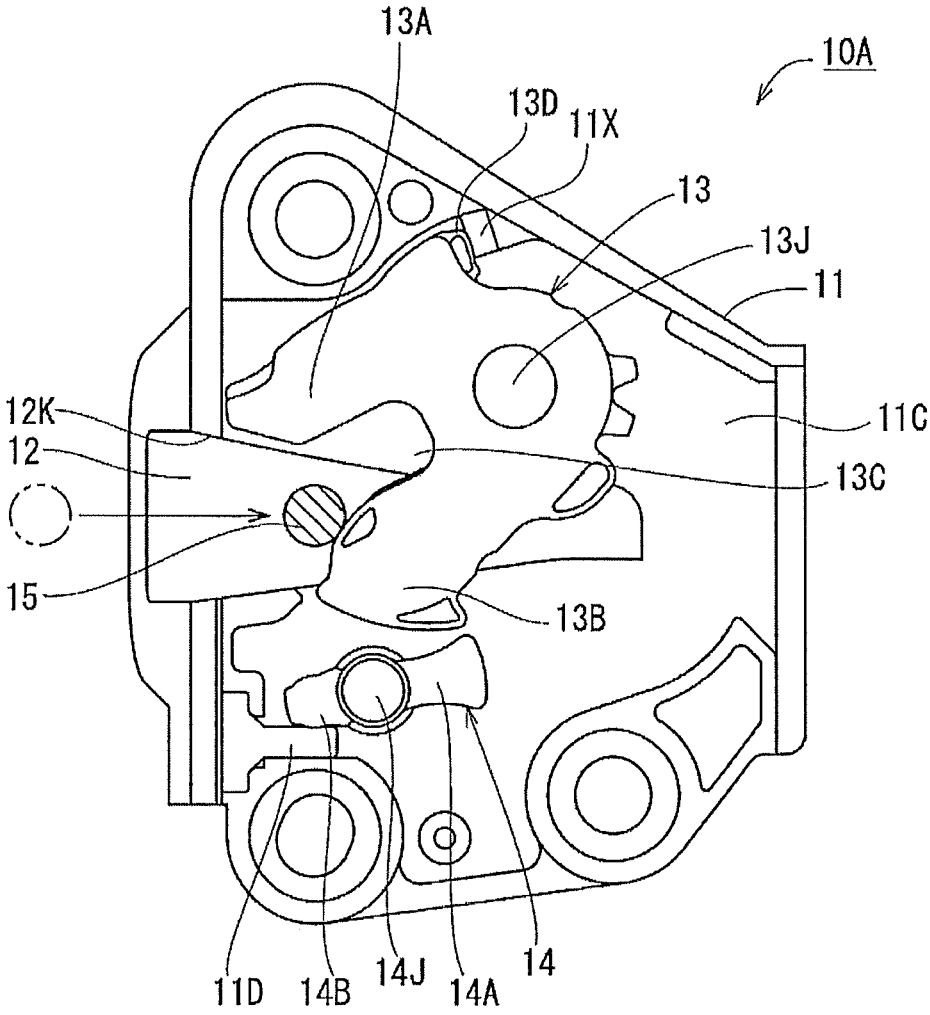
Figure 3B:
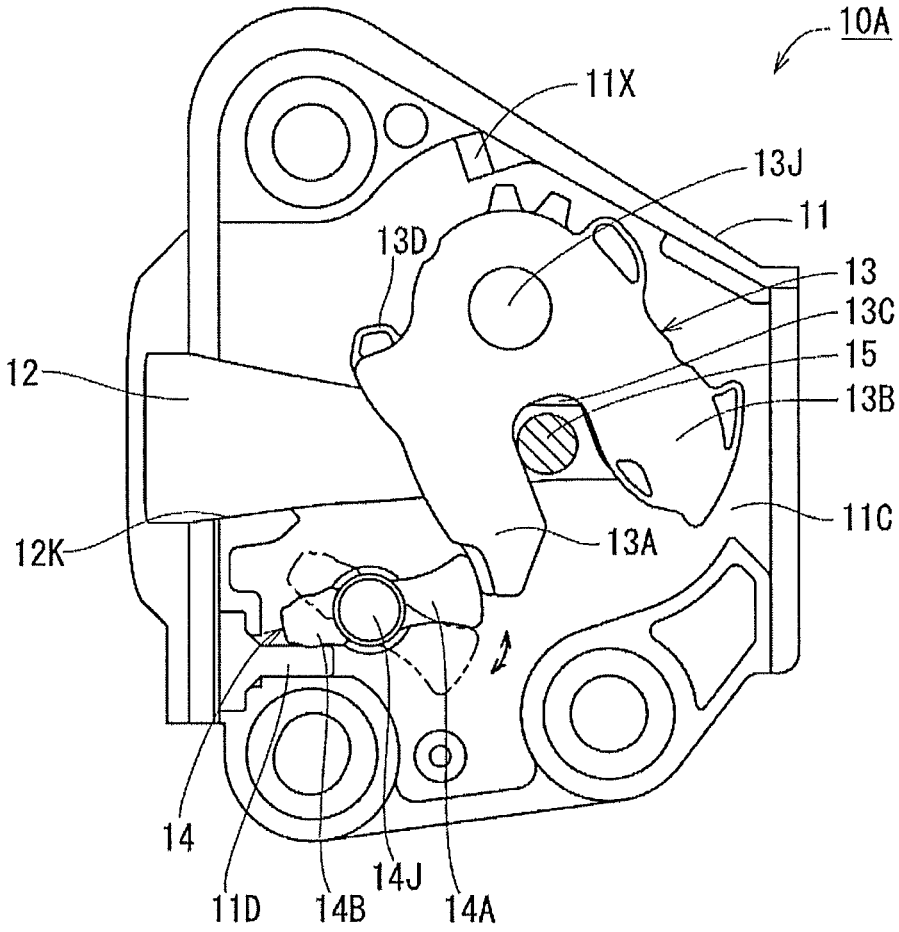

The striker 15 as a whole is formed, for example, by bending a wire material having a circular cross section into a gate-shape configuration, and a pair of leg portions of the gate-shape configuration protrudes from the inner surface of the door frame 100W and is arranged in an in-out direction. Then, a latch 13 that will be described later engages with one of the pair of leg portions of the striker 15, the one which is positioned closer to the outside. In FIG. 3A and FIG. 3B, only a part of the striker 15, the part which engages with the latch 13, is shown.

As shown in FIG. 1, a lid body 11F is provided at the first outer surface 11A of the support body 11, and the latch 13 and a ratchet 14 (which might be referred to also as "a pawl") which are shown in FIG. 3A and FIG. 3B are assembled on an inner side relative to the lid body 11F. As shown in FIG. 3A, the latch 13 includes first and second locking tabs 13A, 13B which are parallel to each other, and between these first and second locking tabs 13A, 13B refers to a striker receiving portion 13C. A latch rotation axis body 13J, which is provided at a portion at which the first and second locking tabs 13A, 13B of the latch 13 are connected to each other, is rotatably supported at the support body 11, at an upper-side portion relative to the striker receiving groove 12, and the latch 13 rotates in a plane that is parallel to the first outside surface 11A of the support body 11.

In addition, the latch 13 is biased in an unlatch direction (in the clockwise direction in FIG. 3A) by a torsion spring which is provided between the latch 13 and the support body 11 and which is not shown in the drawing. Then, in a state where the door 101 is opened, the latch 13 is positioned at an unlatched position (the position indicated in FIG. 3A) by means of a contact of a stopper contact portion 13D provided at the latch 13 and a stopper 11X provided at the support body 11 with each other.

At the unlatched position, a state is formed in which the first locking tab 13A is evacuated and positioned above the striker receiving groove 12, and the second locking tab 13B is across the striker receiving groove 12, and an opening end of the striker receiving portion 13C faces towards the striker receiving opening 12K of the striker receiving groove 12. Then, the striker 15 entering the striker receiving groove 12 is received in the striker receiving portion 13C, and the striker 15 pushes the second locking tab 13B and thus the latch 13 rotates in a latch direction (in the counter-clockwise direction in FIG. 3A). Thus, as shown in FIG. 3B, a side of the striker receiving groove 12, which is closer to the striker receiving opening 12K relative to the striker 15, is covered with the first locking tab 13A, and the latch 13 is brought in a state where the latch 13 engages with the striker 15.

The ratchet 14 is for holding the latch 13 in a state where the latch 13 engages with the striker 15, and the ratchet 14 rotates about a ratchet rotation axis body 14J, which is arranged at the support body 11, at a lower position relative to the striker receiving groove 12, in a same plane as the latch 13. In addition, the ratchet 14 includes a latch rotation restriction piece 14A and a stopper piece 14B which protrude from the ratchet rotation axis body 14J in different directions from each other. Further, the ratchet 14 is biased in the counter-clockwise direction in FIG. 3A by a torsion spring which is attached between the ratchet 14 and the support body 11 and which is not shown in the drawing. Thus, the ratchet 14 is normally positioned at an original position at which the stopper piece 14B is in contact with a ratchet stopper 11D provided at the support body 11. At this original position, the latch rotation restriction piece 14A of the ratchet 14, and the first locking tab 13A and the second locking tab 13B of the latch 13 interfere with each other. In a case where the ratchet 14 rotates from the original position in the clockwise direction and reaches a release position, the latch rotation restriction piece 14A of the ratchet 14, and the first locking tab 13A and the second locking tab 13B of the latch 13 come not to interfere each other.

In a case where the door 101 is closed from a state in which the door 101 is open, the ratchet 14 engages with the latch 13 in a manner that will be described below. When the door 101 is closed, the second locking tab 13B and the first locking tab 13A of the latch 13 are pushed by the striker 15 to rotate, and push down the latch rotation restriction piece 14A of the ratchet 14 and pass the latch rotation restriction piece 14A of the ratchet 14 sequentially. Then, in a case where the door 101 reaches a position where the door 101 pushes and crushes a sound insulation member between the door 101 and the door frame 100W to a maximum extent, the latch 13 reaches an over stroke position where the second locking tab 13B is slightly away from the latch rotation restriction piece 14A of the ratchet 14, and thereby the ratchet 14 returns to the original position. Then, when the door 101 is pushed back by a resilient force of the sound insulation member, the latch rotation restriction piece 14A of the ratchet 14 impacts against the first locking tab 13A of the latch 13 from an opposite side to the striker receiving portion 13C, and the latch 13 is positioned at a fully-latched position. Thus, a fully-latched state, at which the latch 13 is restricted from rotating in an unlatch direction, is formed and the door 101 is kept in a fully-closed state.

Figure 2A:
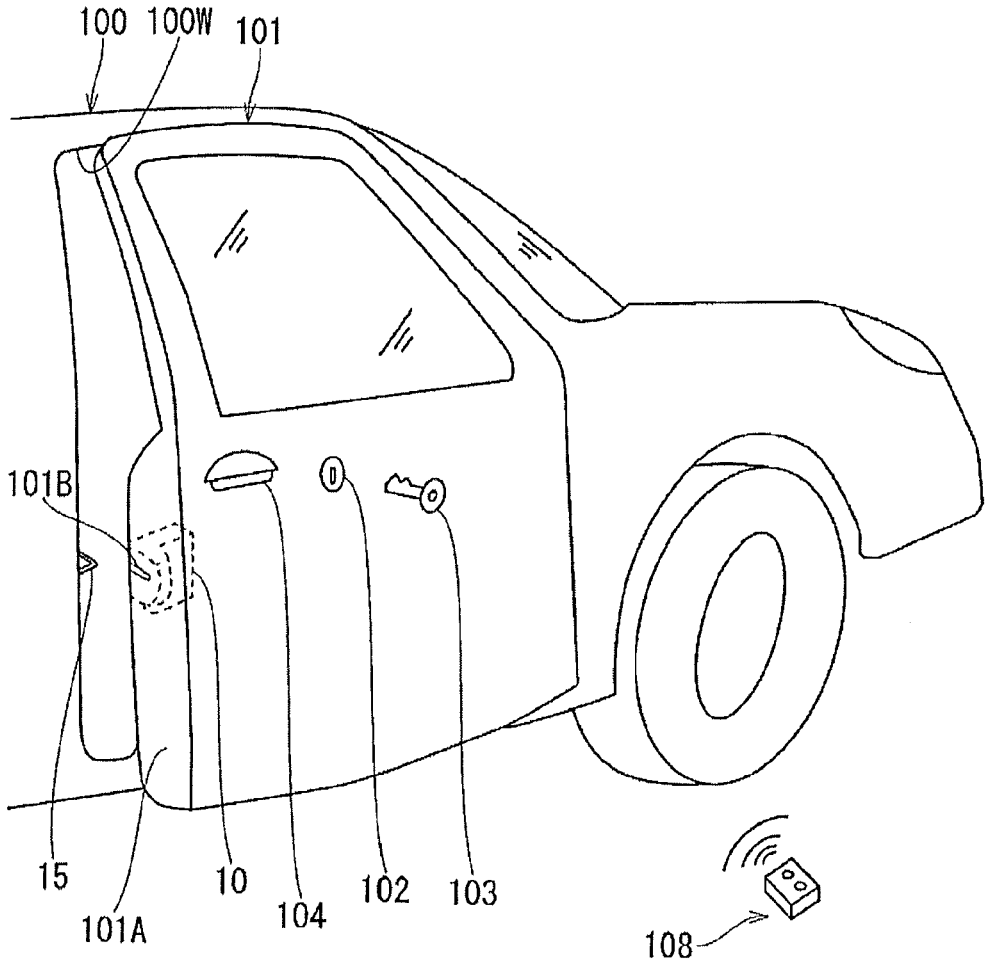
Figure 2B:
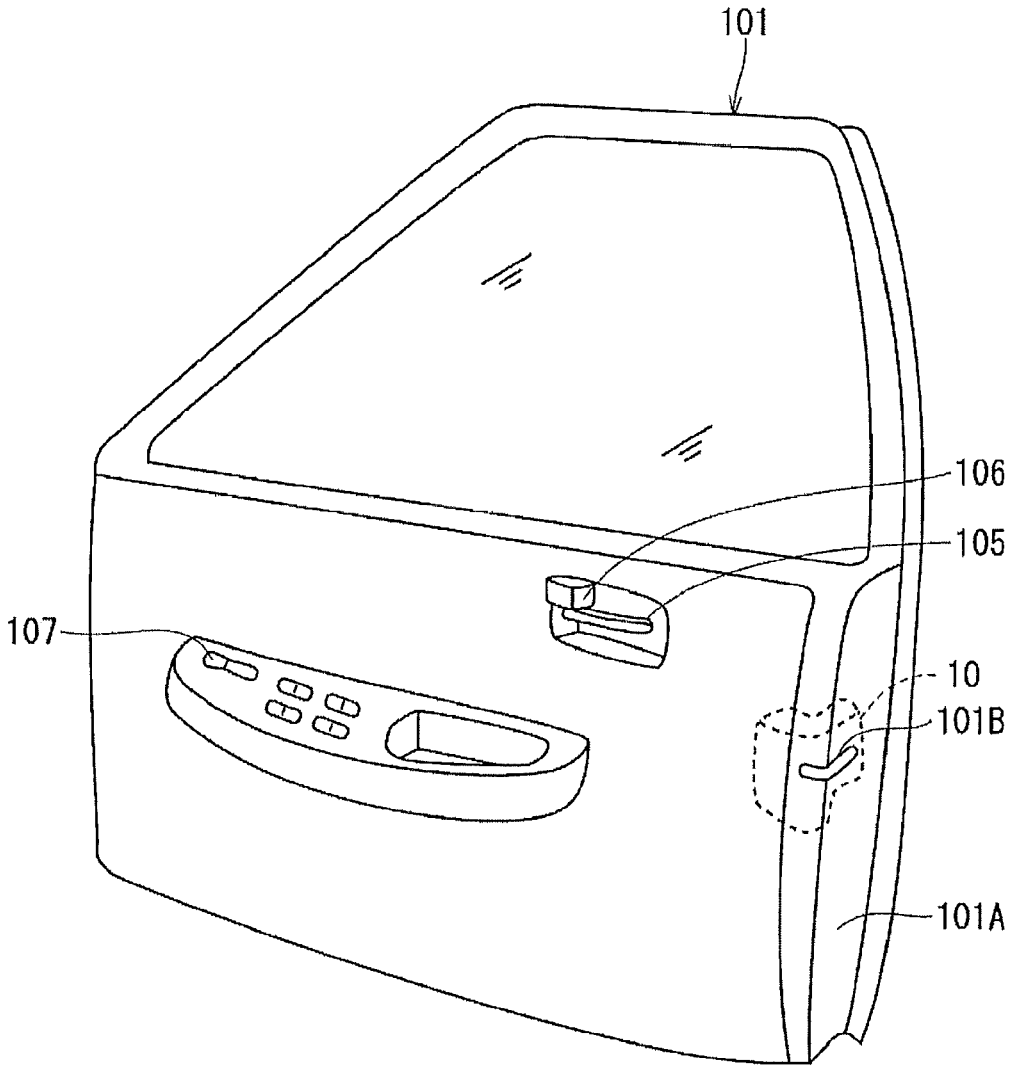

A rotation restriction imposed on the latch 13 by the ratchet 14 can be released by either of an outside door handle 104 provided at a vehicle outside surface of the door 101 as shown in FIG. 2A or an inside door handle 105 provided at a vehicle inside surface as shown in FIG. 2B. In order to transmit an operation force from the outside door handle 104 and the inside door handle 105 to the ratchet 14, a lift lever 16 shown in FIG. 4A is attached to the ratchet rotation axis body 14J so as to be integrally rotatable.

Figure 4A:
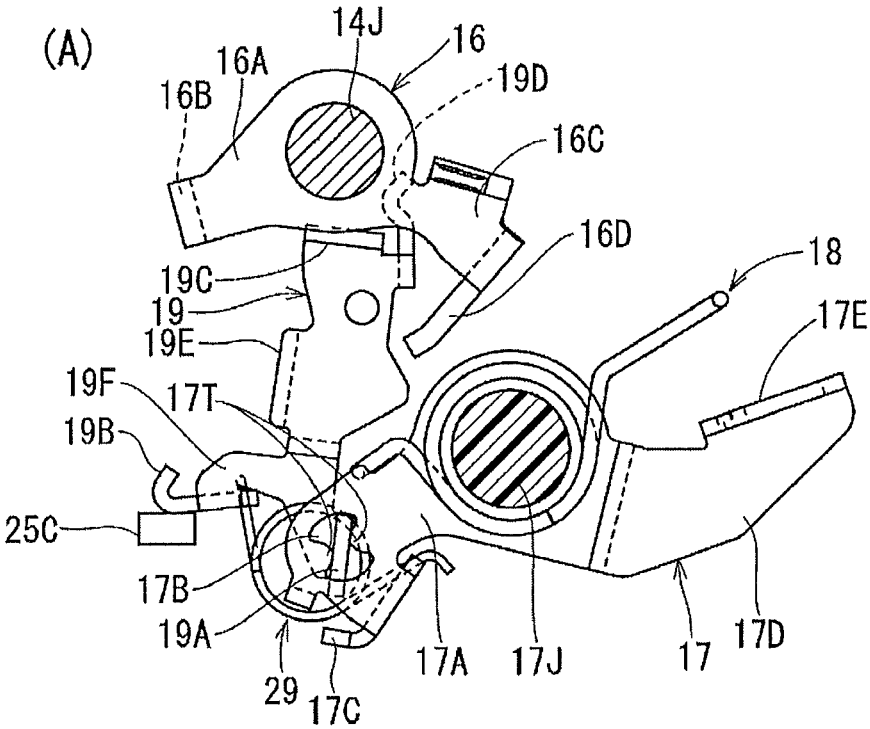

Specifically, the ratchet rotation axis body 14J is rotatably supported at the support body 11 in a state where the ratchet rotation axis body 14J passes through a base wall 11C (see FIG. 3A) of the support body 11, which faces the lid body 11F (see FIG. 1), and the lift lever 16 shown in FIG. 4A is fixed in an integrally rotatable manner to an end portion of the ratchet rotation axis body 14J, the end portion which protrudes towards a reverse surface of the base wall 11C.

The lift lever 16 is provided with a first tilt arm 16A protruding from the ratchet rotation axis body 14J towards a side (hereunder, this will be referred to as "a front side" and an opposite side thereto will be referred to as "a rear side") of the striker receiving opening 12K of the striker receiving groove 12 (see FIG. 3A) and is provided with a second tilt arm 16C protruding from the ratchet rotation axis body 14J obliquely downwardly towards the rear side. The first tilt arm 16A is provided with a distal end contact portion 16B formed by bending a distal end portion thereof in an axial direction of the ratchet rotation axis body 14J, and the second tilt arm 16C is provided with a contacting protruding piece 16D which is formed by bending a distal end portion thereof in the axial direction of the ratchet rotation axis body 14J and which protrudes from the second tilt arm 16C obliquely downwardly towards the front side.

An outside open lever rotation axis body 17J is provided at the rear side relative to the ratchet rotation axis body 14J, at a position obliquely below the ratchet rotation axis body 14J so as to be parallel to the ratchet rotation axis body 14J, and an outside open lever 17 is rotatably supported at the outside open lever rotation axis body 17J.

The outside open lever 17 is provided with a support arm 17A protruding from the outside open lever rotation axis body 17J towards the front side and an operation arm 17D procuring from the outside open lever rotation axis body 17J towards the rear side. Then, a rotation range of the outside open lever 17 is restricted by a stopper which is not shown in the drawing, and the outside open lever 17 rotates between a non-operation position shown in FIG. 4A and FIG. 4B, and an operation position (see FIG. 5A and FIG. 5B) which is rotated in the clockwise direction in these drawings by a predetermined angle relative to the non-operation position. In addition, the outside open lever 17 is biased to the non-operation position by a torsion spring 18 which is shown in FIG. 4A (which is not shown in FIG. 4B, FIG. 5A, FIG. 5B).

An engagement hole 17B is formed so as to pass through a distal end portion of the support arm 17A in a direction that is parallel to an axial direction of the outside open lever rotation axis body 17J. The engagement hole 17B is formed in a shape that includes a pair of mound-shaped protruding portions 17T, 17T protruding from two positions which are at an inner circumferential surface of a circular-shaped hole and are apart from each other by 180 degrees, and the mound-shaped protruding portions 17T, 17T protrude towards a side at which the mound-shaped protruding portions 17T, 17T are close to each other.

At a lower edge portion of a distal end of the support arm 17A, a pressure receiving piece 17C is protrudingly formed by being bent in the axial direction of the outside open lever rotation axis body 17J, Then, in a case where the inside door handle 105 is operated, an inside open lever 20, which will be described later, comes in contact with the pressure receiving piece 17C from below and thus rotates the outside open lever 17 from the non-operation position to the operation position.

In addition, at an upper edge portion of a distal end of the operation arm 17D, a rod engagement piece 17E is protrudingly formed by being bent in the axial direction of the outside open lever rotation axis body 17J. Then, a rod, which is connected to the rod engagement piece 17E and is not shown in the drawing, is connected to the outside door handle 104, and the rod engagement piece 17E is pushed downwardly in a case where the outside door handle 104 is operated, and thus the outside open lever 17 rotates from the non-operation position to the operation position.

As shown in FIG. 4A, an engagement protruding piece 19A of an open link 19 is rotatably engaged at the engagement hole 17B of the outside open lever 17. The open link 19 is shaped so that the whole of the open link 19 extends in an up/down direction, and the above-described engagement protruding piece 19A protrudes from a lower end portion of the open link 19 in the axial direction of the outside open lever rotation axis body 17J. Then, a rotation range of the open link 19 is restricted by the above-described pair of mound-shaped protruding portions 17T, 17T at the engagement hole 17B, and the open link 19 rotates between an unlock position where being tilted forward and a lock position where being tilted rearward. In addition, as shown in FIG. 4A, a torsion spring 29 (not shown in FIG. 4B, FIG. 5A, FIG. 5B) is provided between the open link 19 and the outside open lever 17, and the open link 19 is biased by the torsion spring 29 toward the unlock position.

Figure 4B:
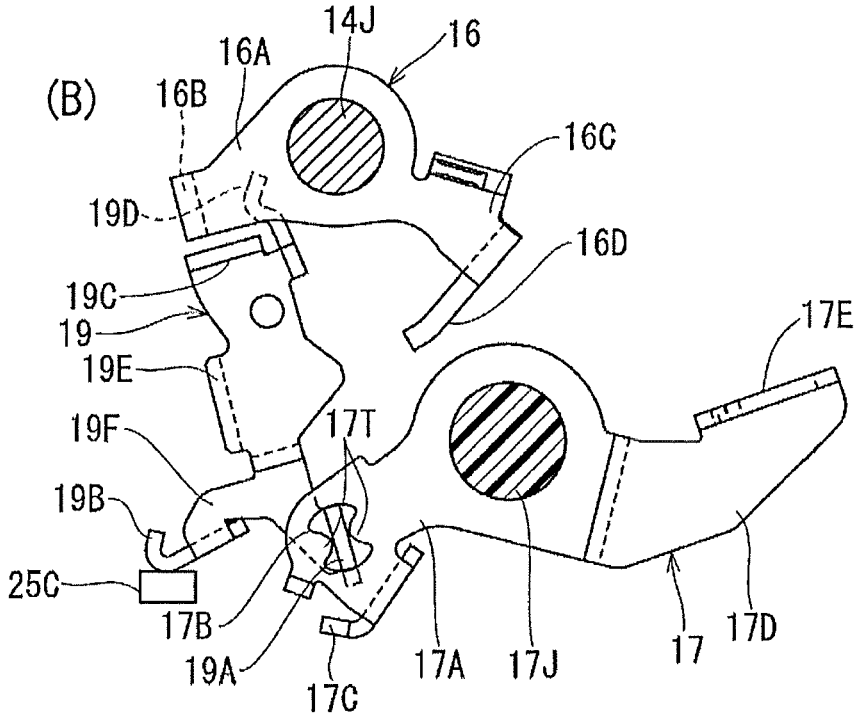
Figure 5A:
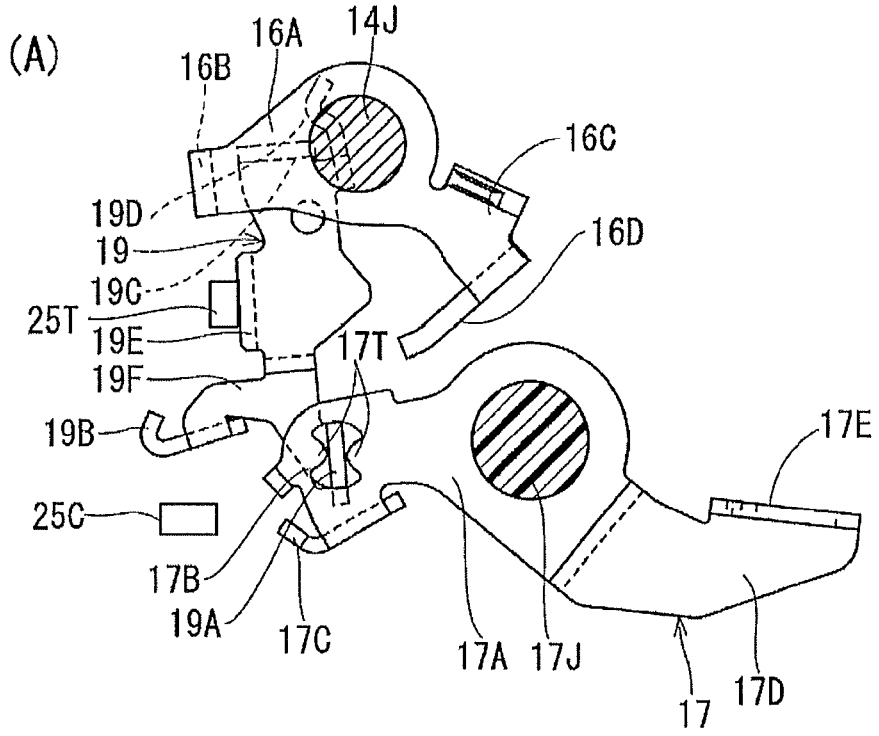
Figure 5B:
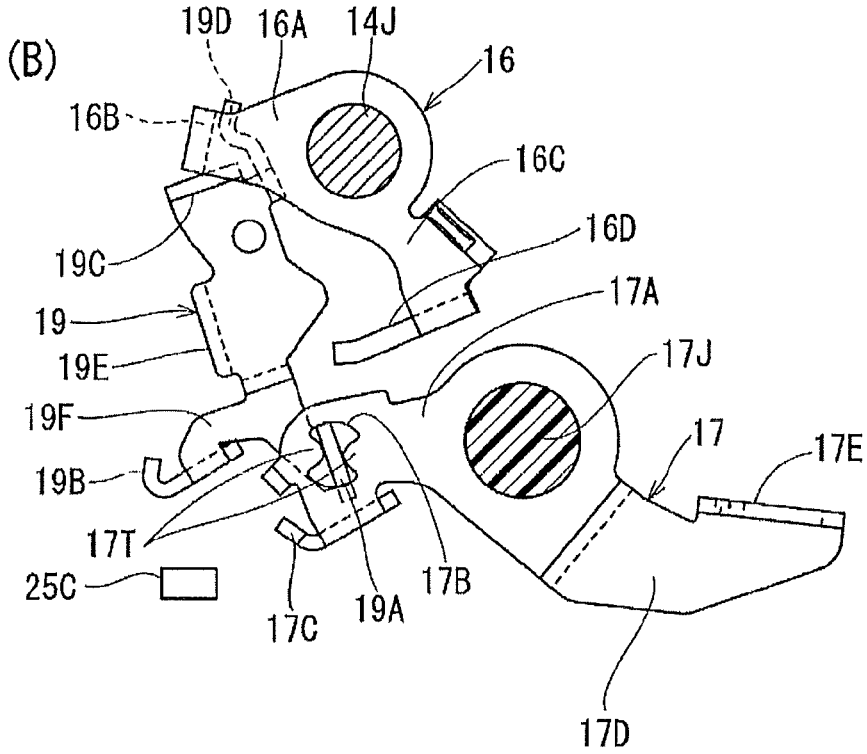

At an upper edge portion of the open link 19, a push-up protruding piece 19C is protrudingly formed by being bent in the axial direction of the outside open lever rotation axis body 17J. Then, in a case where the open link 19 is positioned at the unlock position, the push-up protruding piece 19C is positioned below the distal end contact portion 16B of the lift lever 16 as shown in FIG. 4B, and in this state, when the outside open lever 17 rotates from the non-operation position to the operation position, the push-up protruding piece 19C pushes up the distal end contact portion 16B of the lift lever 16 as shown in FIG. 5B. Thus, the lift lever 16 rotates from the original position to the release position together with the ratchet 14 (see FIG. 3B), and the engagement of the ratchet 14 and the latch 13 with each other is released, and thus the door 101 is opened.

On the other hand, in a case where the open link 19 is positioned at the lock position, the push-up protruding piece 19C is dislocated from the distal end contact portion 16B of the lift lever 16 toward the ratchet rotation axis body 14J as shown in FIG. 4A. Thus, in this state, even in a case where the outside open lever 17 rotates from the non-operation position to the operation position, the push-up protruding piece 19C does not push up the distal end contact portion 16B of the lift lever 16 as shown in FIG. 5A. That is, in a case where the open link 19 is positioned at the lock position, a locked state in which the door 101 cannot be opened even though the outside door handle 104 is operated is formed. A latch unit 10A (see FIG. 1, FIG. 3A and FIG. 3B) related to this invention is configured by supporting the latch 13, the ratchet 14 and the lift lever 16 at the base wall 11C and at the lid body 11F as a unit.

From a rear edge portion of an upper end portion of the open link 19, a rotation restriction protruding portion 19D is bent in the axial direction of the outside open lever rotation axis body 17J and the rotation restriction protruding portion 19D protrudes upwardly from the push-up protruding piece 19C. In addition, an upper end portion of the rotation restriction protruding portion 19D is bent toward the front side so as to form a mount configuration. Then, in a case where the outside open lever 17 rotates to the operation position when the open link 19 is at the unlock position, the rotation restriction protruding portion 19D is lifted up while being guided by an unlock retaining protruding portion which is not shown in the drawing. That is, the rotation restriction protruding portion 19D and the unlock retaining protruding portion are for holding the open link 19, which is away from an active operation arm 25C of an active lever 25, in an unlocked state.

A lower end arm 19F protrudes forward from a position closer to a lower end of the open link 19, and a lock-release piece 19B is bent from a lower edge portion of the lower end arm 19F in the axial direction of the outside open lever rotation axis body 17J so as to protrude forward. Then, the open link 19 is switched from the unlock position to the lock position in a case where the lock-release piece 19B is pushed upwardly by the active lever 25 which will be described later.

From a front edge portion of an intermediate portion of the open link 19 in the up/down direction, a restriction receiving portion 19E is bent in the axial direction of the outside open lever rotation axis body 17J. The restriction receiving portion 19E will be described together with the active lever 25 which will be described later.

In a case where the door 101 is closed when the open link 19 is positioned at the lock position, the contacting protruding piece 16D of the lift lever 16, which rotates together with the ratchet 14 pushes the open link 19 from rearward so that the open link 19 is moved to the unlock position in a closing process of the door 101. That is, the door locking device 10 of this invention is provided with a cancellation function which releases the locked state in a case where the door 101 is closed when the locked state is formed.

Figure 6:
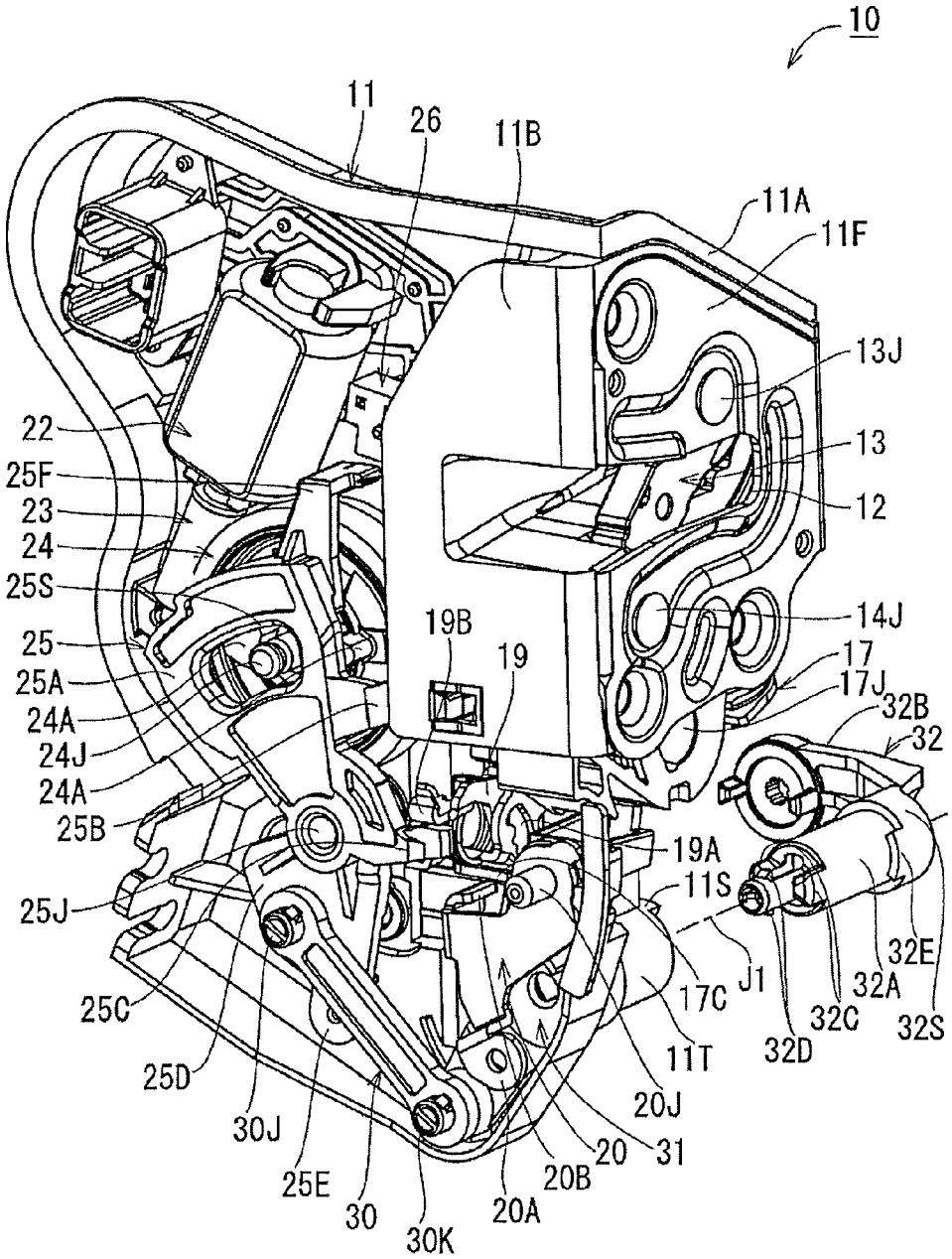

The latch 13, the ratchet 14, the lift lever 16, the outside open lever 17, which are described above, are supported at the support body 11 so as to rotate about a rotation center axis facing a direction that is orthogonal to the first outer surface 11A of the support body 11 (see FIG. 1). However, the inside open lever 20, the active lever 25, a lever connecting member 30, a relay lever 31, a key operation transmission link 32 and the like, which will be described hereunder, are supported at the support body 11 so as to rotate about a rotational center facing a direction that is orthogonal to the second outer surface 11B of the support body 11 as shown in FIG. 6.

The inside open lever 20 rotates about an inside open lever rotation axis body 20J arranged at a position closer to a lower end of a right side portion of the support body 11 when facing the support body 11. In addition, a part of the inside open lever 20 extends from the inside open lever rotation axis body 20J toward a central side in a lateral direction of the support body 11, and a distal end portion thereof is bent in the axial direction of the inside open lever rotation axis body 20J and forms a push-up contact portion 20B. In addition, another part of the inside open lever 20 protrudes toward downward and a distal end portion thereof forms a wire locking piece 20A. Then, the inside door handle 105 is connected to the wire locking piece 20A via a wire W1 (see FIG. 8).

In addition, because the wire W1 is assembled on the inside open lever 20, the inside open lever 20 is held in a non-operation position where the wire locking piece 20A is in contact with a wall surface of the support body 11. Then, in a case where the inside door handle 105 is operated, the inside open lever 20 is pulled via the wire W1 towards the left side in FIG. 9, and the inside open lever 20 rotates to an operation position in the clockwise direction in this drawing. During this time, the push-up contact portion 20B of the inside open lever 20 pushes up the pressure receiving piece 17C of the outside open lever 17, which is described above, and the outside open lever 17 also rotates from the non-operation position to the operation position. At this time, the door 101 opens as described above in a case where the open link 19 is positioned at the unlock position, and the door 101 does not open in a case where the open link 19 is positioned at the lock position. In a case where the operation of the inside door handle 105 is stopped, the inside open lever 20 is moved from the operation position to the non-operation position by means of a spring which is provided at the inside door handle 105 and which is not shown in the drawing.

The active lever 25 for switching the open link 19 from the unlock position to the lock position rotates about an active lever rotation axis body 25J which is arranged at the support body 11, at an opposite side position that is opposite to the inside open lever rotation axis body 20J, with the open link 19 interposed between the active lever rotation axis body 25J and the inside open lever rotation axis body 20J. In addition, the active lever 25 is provided with a first fan-shaped protruding piece 25A jutting out upwardly from the active lever rotation axis body 25J, a second fan-shaped protruding piece 25D formed in a fan shape and jutting out obliquely left downward from the active lever rotation axis body 25J, and the active operation arm 25C protruding from the active lever rotation axis body 25J toward an obliquely right side.

Figure 7:
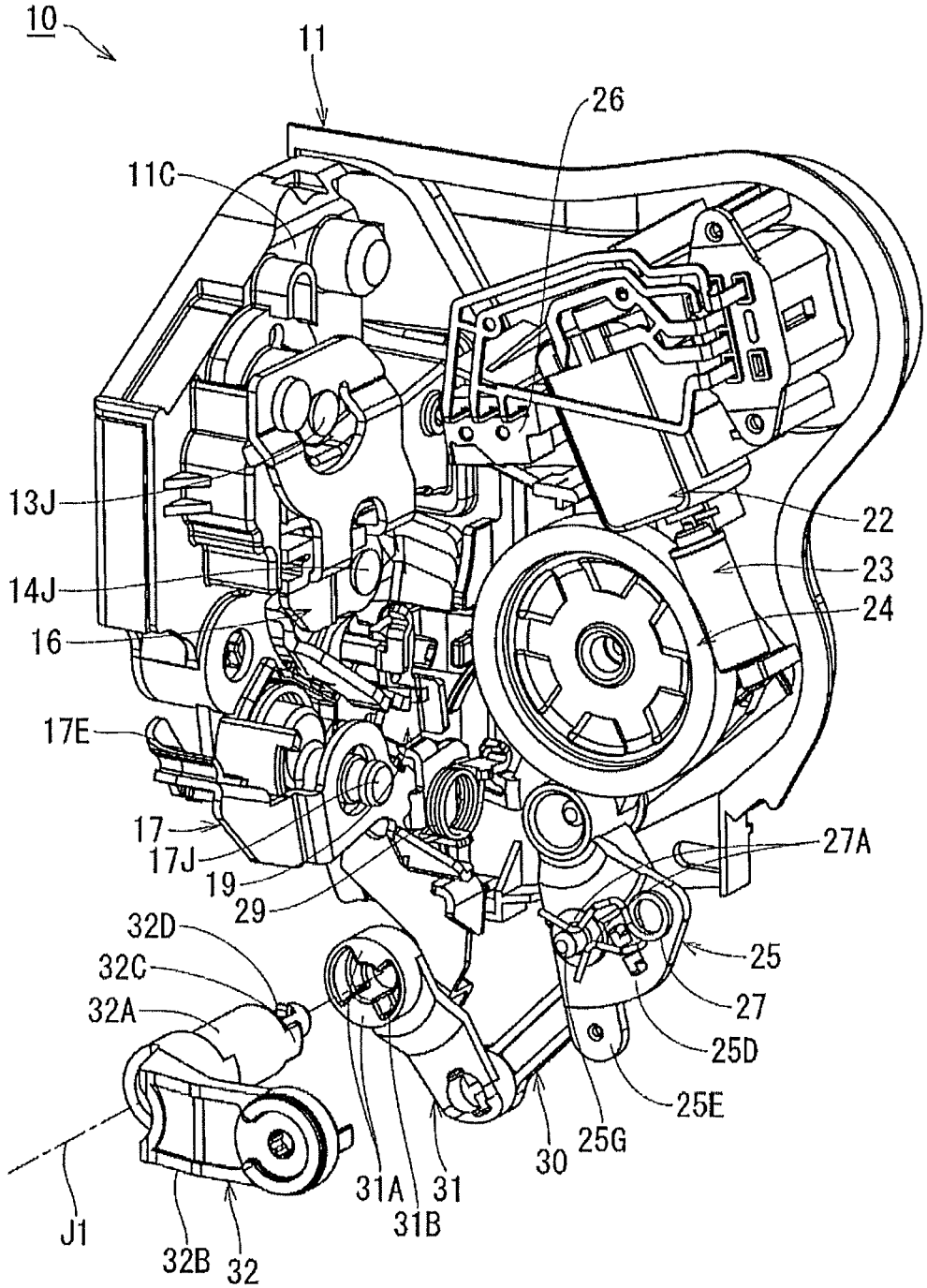
Figure 8:
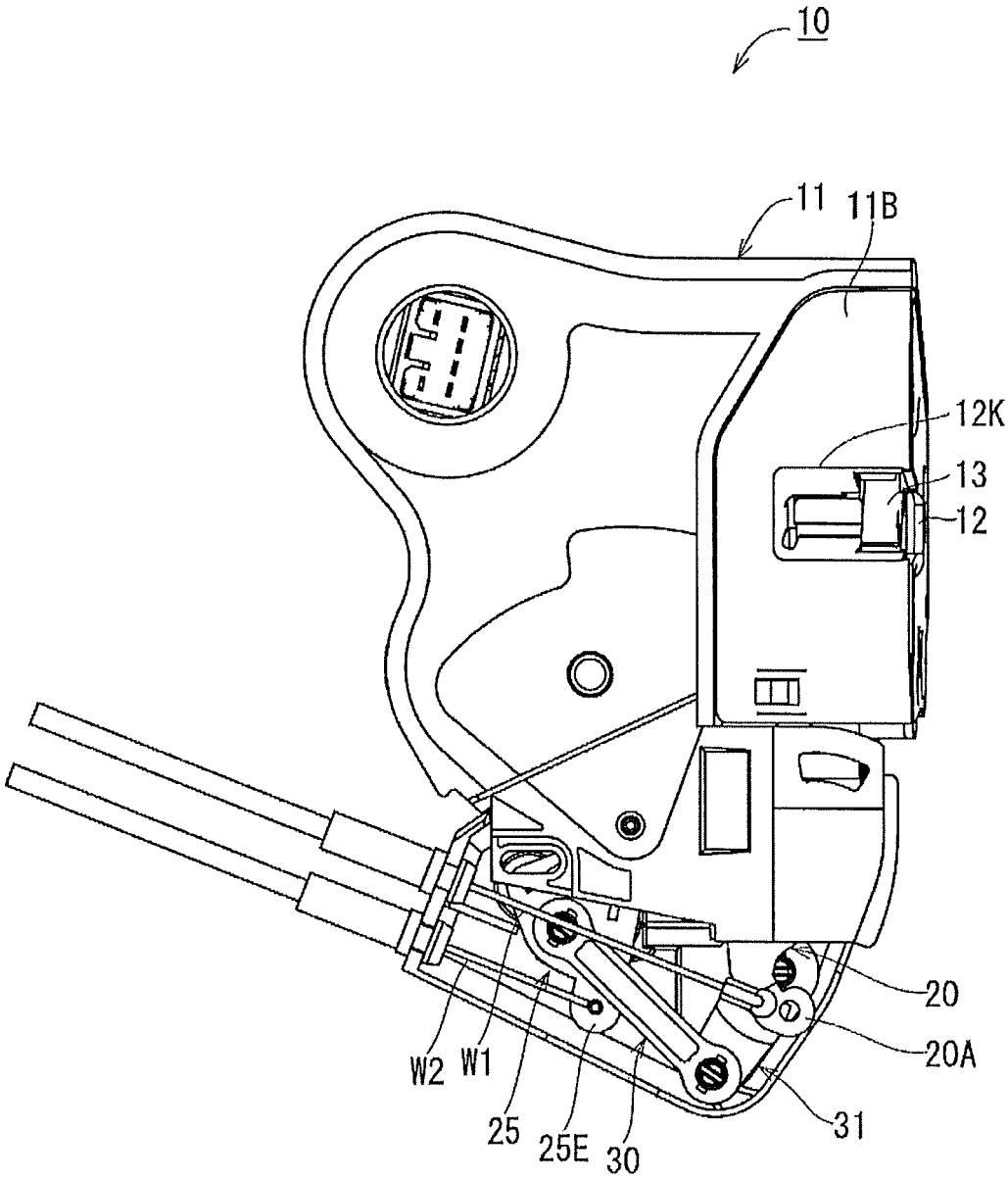

As shown in FIG. 7, a positioning support column 25G formed in a columnar shape protrudes from a reverse surface of the second fan-shaped protruding piece 25D. In addition, a special-shaped spring 27 is attached to a surface of the support body 11, the surface which faces the second fan-shaped protruding piece 25D. The special-shaped spring 27 includes a configuration where an intermediate portion of a spring wire material is wound in a coil configuration and both end portions of the spring wire material face each other, and a pair of sliding contact protruding portions 27A, 27A is formed by bending a position closer to a distal end of each of these facing portions in a mound configuration toward a side at which the facing portions come close to each other. Then, in a case where the active lever 25 rotates between an unlock position shown in FIG. 10 and a lock position shown in FIG. 11, the positioning support column 25G passes between the pair of sliding contact protruding portions 27A, 27A while pushing the pair of sliding contact protruding portions 27A, 27A apart from each other, and thus the active lever 25 is biased to either of the unlock position or the lock position, and therefore is configured not to stop at intermediate positions therebetween.

Figure 10:
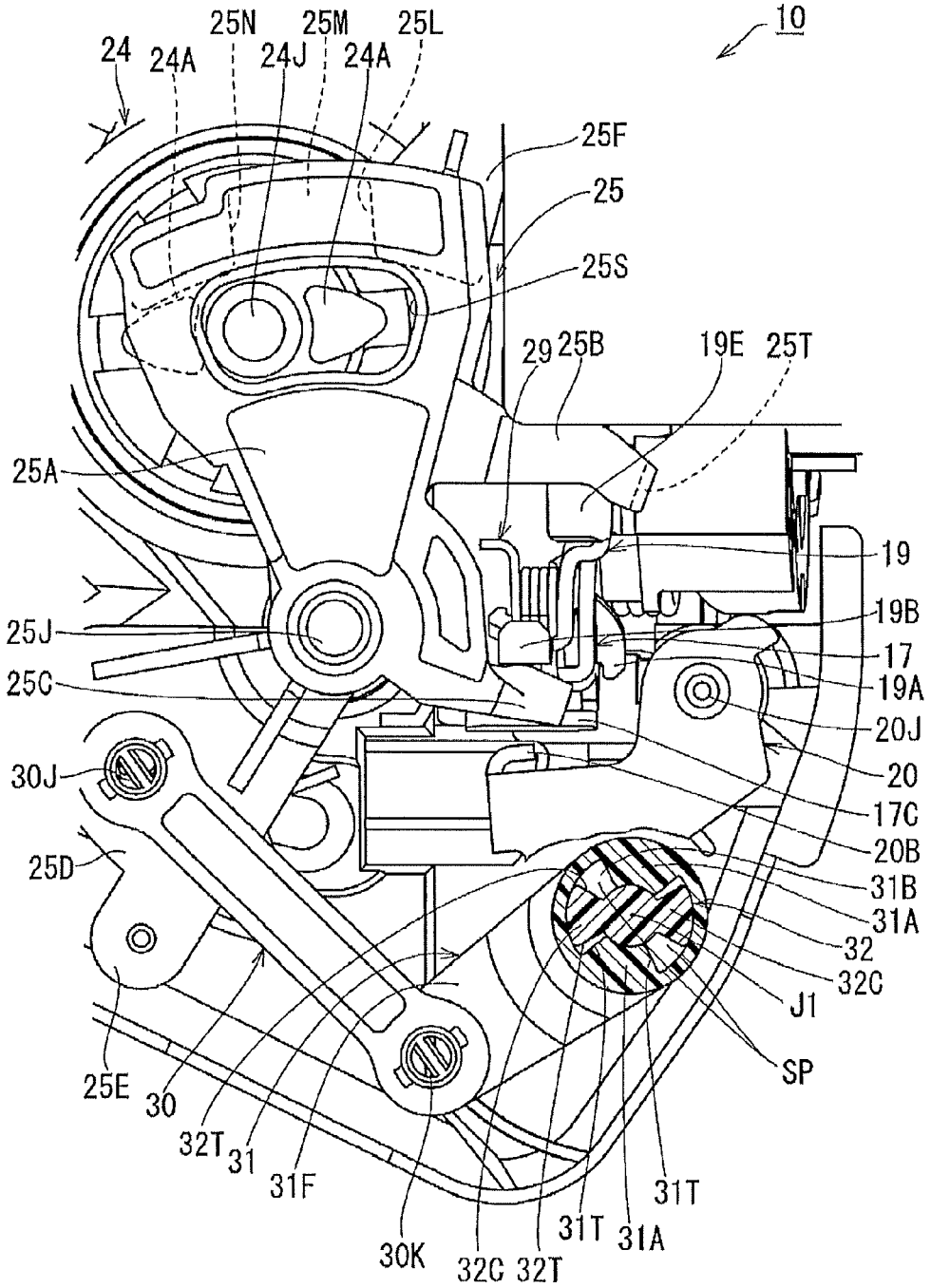

As shown in FIG. 10, a distal end portion of the active operation arm 25C faces the lock-release piece 19B of the open link 19 from below. Then, as indicated in a change from FIG. 10 to FIG. 11, in a case where the active lever 25 rotates from the unlock position to the lock position, the active operation arm 25C pushes up the lock-release piece 19B and moves the open link 19 from the unlock position to the lock position.

A lock retaining arm 25B protrudes from one side edge portion, which is at a side closer to the active operation arm 25C, of the first fan-shaped protruding piece 25A. A part of the lock retaining arm 25B faces the restriction receiving portion 19E of the open link 19, and a lock retention protruding portion 25T (see FIG. 10) protrudes from a distal end portion of the lock retaining arm 25B towards the restriction receiving portion 19E. Then, in a case where the active lever 25 is positioned at the unlock position, the lock retention protruding portion 25T is dislocated from a front of the restriction receiving portion 19E as shown in FIG. 10, and in a case where the active lever 25 is positioned at the lock position, the lock retention protruding portion 25T is brought in contact with the restriction receiving portion 19E from the front as shown in FIG. 5A. Thus, in a case where the active lever 25 is positioned at the lock position, the open link 19 is kept in the locked state by the lock retention protruding portion 25T even though the lock-release piece 19B of the open link 19 is away from the active operation arm 25C.

Figure 9:
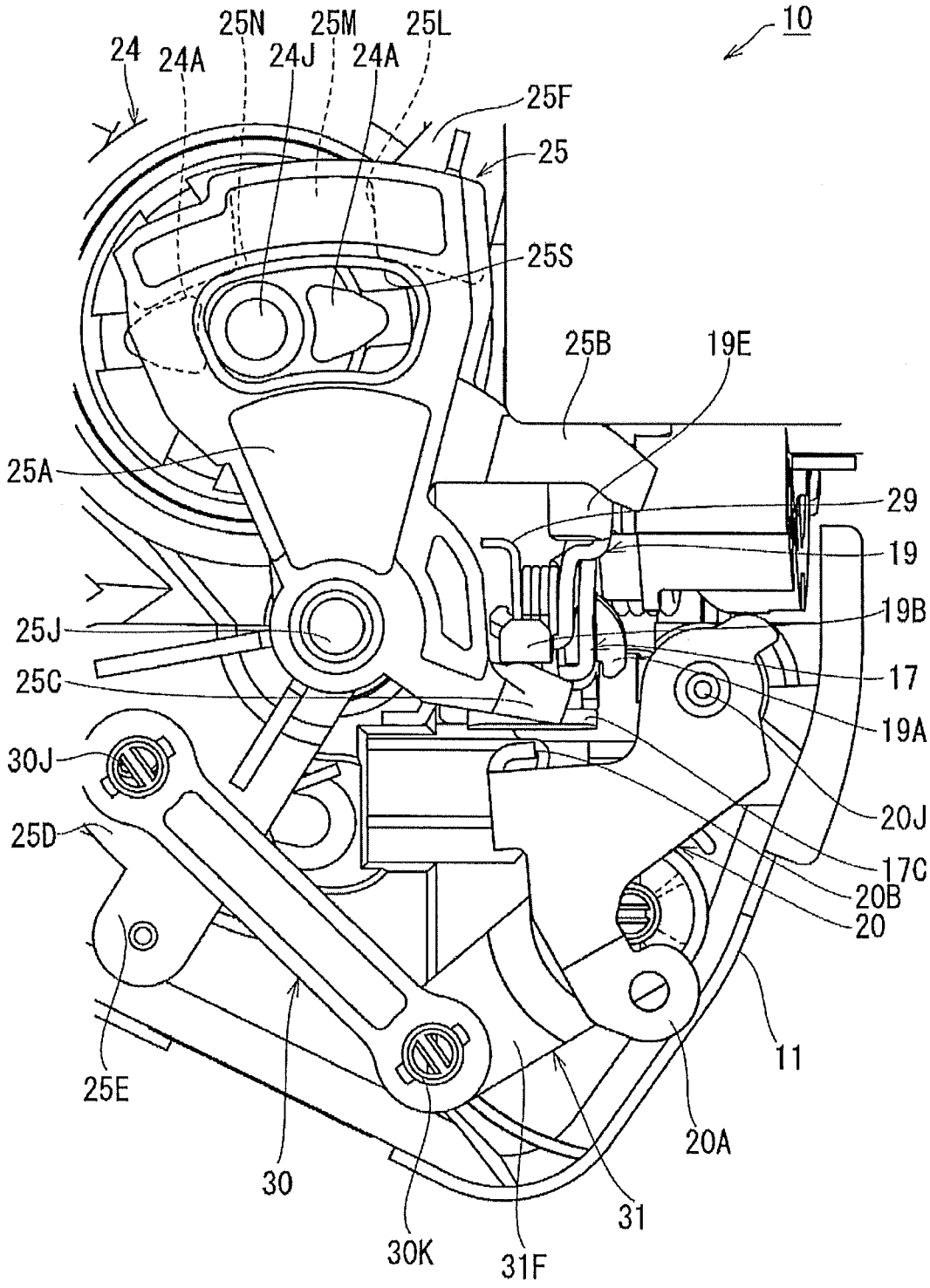

As shown in FIG. 9, a wire connection piece 25E projects from a lower end portion of the second fan-shaped protruding piece 25D. A lock operation portion 106 (FIG. 2B) which is provided at the vehicle interior side of the door 101 is connected to the wire connection piece 25E via a wire W2 (which corresponds to "a wire-shaped member" related to this invention, see FIG. 8). Then, in a case where the lock operation portion 106 is operated, the active lever 25 can be switched to the unlock position and to the lock position.

The active lever 25 can be switched to the unlock position and to the lock position by a centralized lock operation switch 107 (see FIG. 2B) inside the vehicle and/or by a wireless key 108 (see FIG. 2A), in addition to by the lock operation portion 106 provided at the vehicle interior side of the door 101. For this purpose, a motor 22 shown in FIG. 6 is attached to the support body 11. The motor 22 is arranged at the support body 11, above the active lever 25, and a rotation output shaft of the motor 22 protrudes obliquely downwardly to be parallel to the second outer surface 11B, and a worm gear 23 is fixed to the rotation output shaft. In addition, a worm wheel 24, which meshes with the worm gear 23, rotates about a wheel rotation axis body 24J, and the wheel rotation axis body 24J is arranged above relative to the active lever rotation axis body 25J. Then, a part of the worm wheel 24 is positioned between the support body 11 and the first fan-shaped protruding piece 25A, and the wheel rotation axis body 24J is protrudingly inserted in a circular arc hole 25S provided at the first fan-shaped protruding piece 25A.

At a facing surface of the worm wheel 24 which faces the first fan-shaped protruding piece 25A, a pair of rotation-pressing-protruding portions 24A, 24A is protrudingly formed at two positions which interpose the wheel rotation axis body 24J therebetween. On the other hand, a side of the first fan-shaped protruding piece 25A, the side which is away from the active lever rotation axis body 25J than the circular arc hole 25S, is formed to have a thickness which increases towards the worm wheel 24, and an engagement groove 25M is formed at a center of the thickness-increased portion in a circumferential direction. Then, the worm wheel 24 is normally maintained at a position where the rotation-pressing-protruding portions 24A, 24A are arranged along the circumferential direction of the circular arc hole 25S, and the worm wheel 24 rotates in the counter-clockwise direction in FIG. 10 by 180 degrees in a case where a lock operation of the centralized lock operation switch 107 and/or the wireless key 108 is performed. Then, during the rotation of the worm wheel 24, one of the rotation-pressing-protruding portions 24A, 24A enters the engagement groove 25M and then pushes a groove inner surface 25N on the left side in the engagement groove 25M, and the active lever 25 rotates in the counter-clockwise direction and switches from the unlock position shown in FIG. 10 to the lock position shown in FIG. 11.

Figure 11:
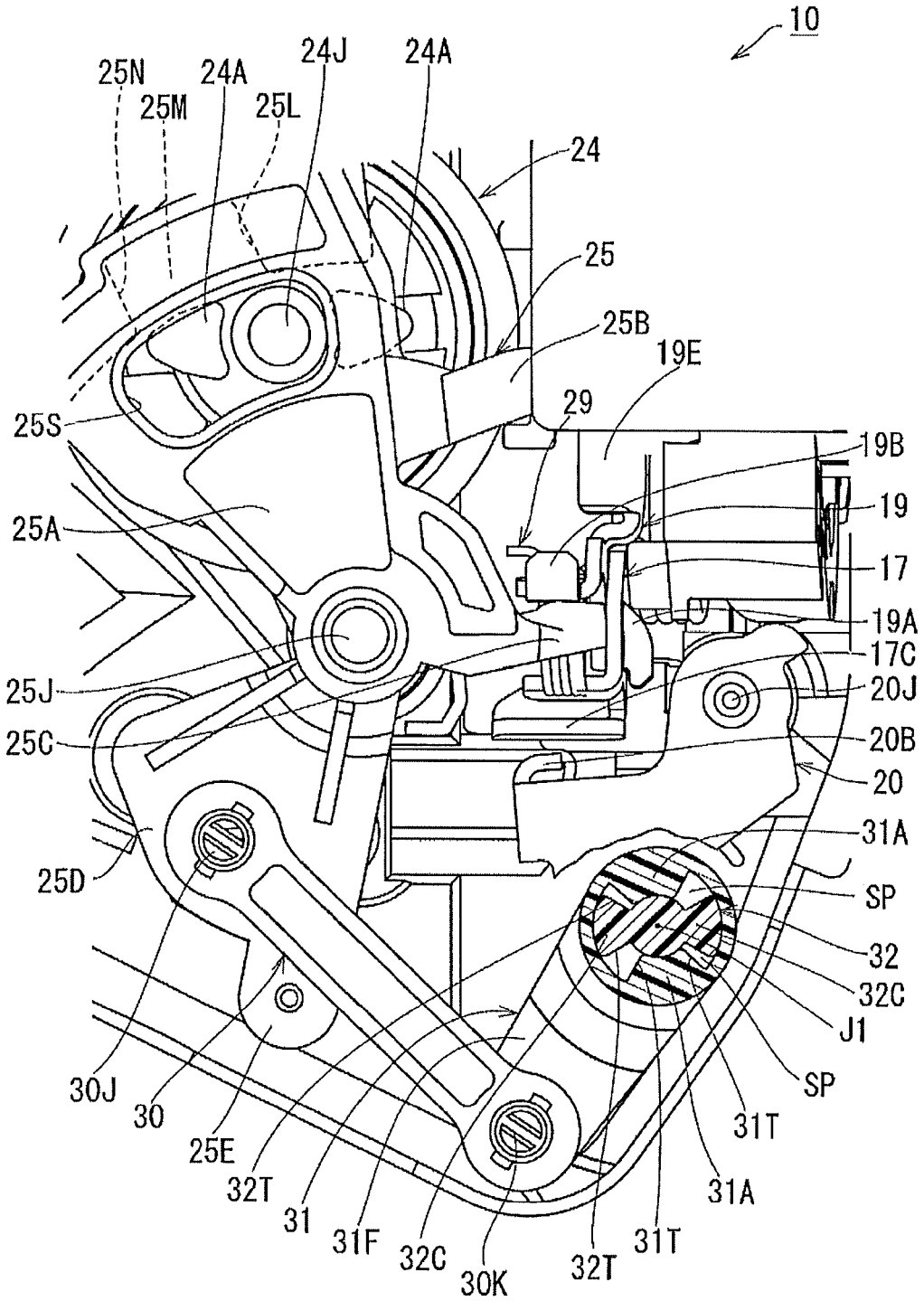

On the other hand, in a case where an unlock operation of the centralized lock operation switch 107 and/or the wireless key 108 is performed, the worm wheel 24 rotates in the clockwise direction in FIG. 11 by 180 degrees. Then, during the rotation of the worm wheel 24, one of the rotation-pressing-protruding portions 24A, 24A enters the engagement groove 25M and then pushes a groove inner surface 25L on the right side in the engagement groove 25M, and the active lever 25 rotates in the clockwise direction, and switches from the lock position shown in FIG. 11 to the unlock position shown in FIG. 10.

As shown in FIG. 6, a detection arm 25F protrudes upwardly from the first fan-shaped protruding piece 25A. A detection switch 26 is attached to the support body 11, above a rotation area of the detection arm 25F, and an actuation portion provided at the detection switch 26 protrudes in the rotation area of the detection arm 25F. Then, in a case where the active lever 25 is positioned at the unlock position, a distal end of the detection arm 25F is dislocated laterally from the actuation portion of the detection switch 26 and the detection switch 26 is turned off, and in a case where the active lever 25 is positioned at the lock position, the distal end of the detection arm 25F pushes the actuation portion of the detection switch 26 and the detection switch 26 is turned on. A control portion, which is provided at the vehicle 100 and is not shown in the drawing, obtains an on/off signal related to the detection switch 26 and can recognize which of the unlock position or lock position the active lever 25 is positioned.

The active lever 25 can be switched to the unlock position and to the lock position also by performing an operation by inserting a key 103 (sec FIG. 2A) into a key cylinder 102 (see FIG. 2A) provided at the door 101 (which will be hereunder simply referred to as "a key operation of the key cylinder 102"). In FIG. 6, whole of the key operation transmission link 32, which is connected to the key cylinder 102, is shown.

The key operation transmission link 32 corresponds to "a key operation transmission member" related to this invention, and includes a configuration where a torque transmission arm 32B projects laterally from a rear end of a torque transmission shaft 32A extending in parallel to the inside open lever rotation axis body 20J. Then, the torque transmission shaft 32A is inserted into a support cylinder 11T from behind and is assembled thereon. The support cylinder 11T projects from a reverse surface of the support body 11, which is an opposite surface to a front surface on which the active lever 25 and the like are assembled.

Figure 12:
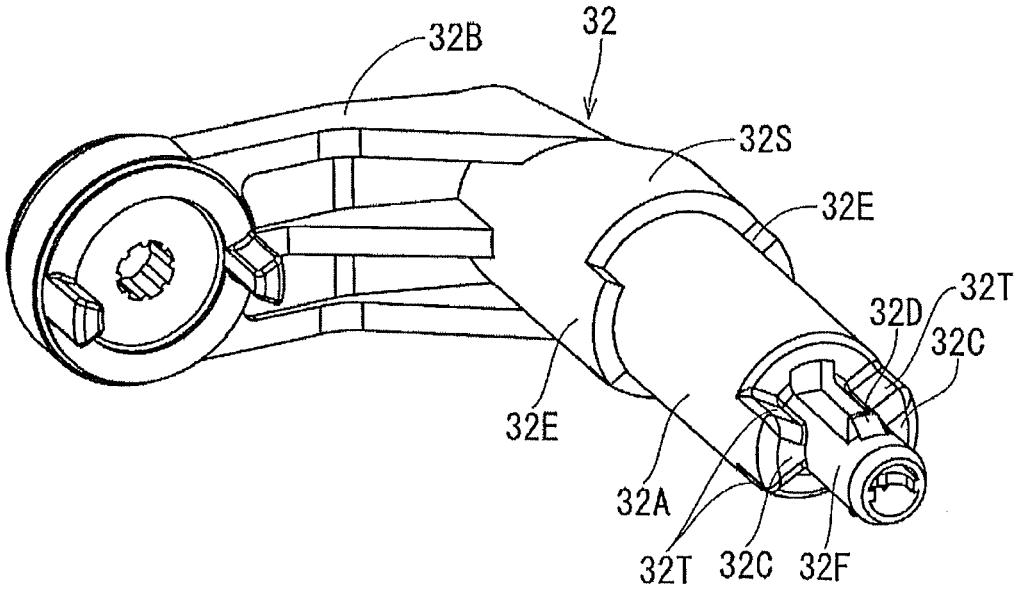
Figure 12:
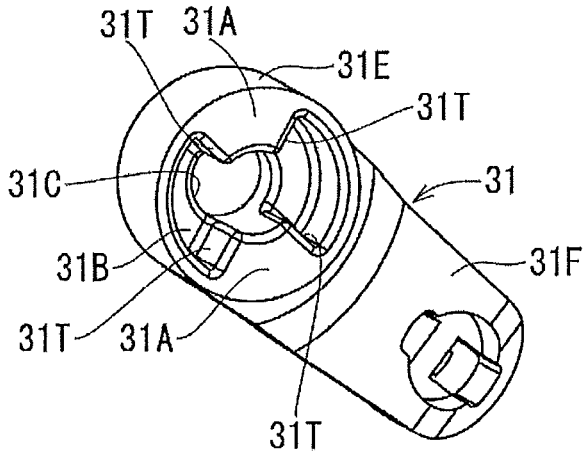

In addition, a stopper 11S protrudes from a rear end surface of the support cylinder 11T, from two positions that are apart from each other by 180 degrees. On the other hand, as shown in FIG. 12, the torque transmission shaft 32A of the key operation transmission link 32 includes a large diameter portion 32S, that is, a diameter of a rear end portion is larger in a stepped configuration, and a stopper contact protruding portion 32E protrudes from two positions, which are apart from each other by 180 degrees, of a stepped surface at a front portion of the large diameter portion 32S. Then, as shown in FIG. 1, a distal end surface of the stopper 11S of the support cylinder 11T is in contact with the stepped surface of the large diameter portion 32S of the key operation transmission link 32, and the stopper contact protruding portions 32E and the stoppers 11S are assembled on each other in a state where the stopper contact protruding portions 32E and the stoppers 11S are arranged alternately with each other in a circumferential direction. Due to the contact of the stopper contact protruding portions 32E and the stoppers 11S with each other, a rotation range of the key operation transmission link 32 is restricted, and the key operation transmission link 32 rotates between a key lock position and a key unlock position.

As illustrated in FIG. 12, a distal end shaft 32F formed in a cylindrical shape that is thinner than the torque transmission shaft 32A protrudes from a center of a distal end surface of the torque transmission shaft 32A of the key operation transmission link 32. At an outer circumferential surface of a distal end portion of the distal end shaft 32F, a pair of lock protrusions 32D, 32D is protrudingly formed at two positions that are away from each other by 180 degrees in the circumferential direction. A portion of the lock protrusion 32D, which faces towards the distal end-side of the distal end shaft 32F, forms a guide surface that is inclined relative to an axial center of the distal end shaft 32F, and a portion of the lock protrusion 32D, which faces towards a base end-side of the distal end shaft 32F of the lock protrusion 32D, corresponds to a detent surface that is orthogonal to the axial center of the distal end shaft 32F.

At an outer circumferential surface of a base end portion of the distal end shaft 32F, a pair of second fan-shaped protruding portions 32C, 32C is provided at two positions that are away from each other by 180 degrees in the circumferential direction, and the pair of second fan-shaped protruding portions 32C, 32C and the above-described pair of lock protrusions 32D, 32D are arranged so that a phase is shifted by 90 degrees. In this embodiment, both lateral surfaces of each of the second fan-shaped protruding portions 32C, 32C correspond to a pair of second movable contact portions 32T, 32T related to this invention, and are so configured that a line, on which the both lateral surfaces of each of the second fan-shaped protruding portions 32C intersect with each other in a case where the both lateral surfaces are extended, coincides with a center line of the torque transmission shaft 32A. In addition, outer circumferential surfaces of the second fan-shaped protruding portions 32C, 32C are flush with an outer circumferential surface of the torque transmission shaft 32A. Then, in a state where the torque transmission shaft 32A is inserted in the support cylinder 11T up to an innermost portion of the support cylinder 11T, a distal end-side of the key operation transmission link 32 relative to the second fan-shaped protruding portions 32C, 32C protrudes towards the front surface side of the support body 11, and the relay lever 31 shown in a lower portion of FIG. 12 is connected to the protruding portion.

The relay lever 31 corresponds to "a lock switch member" related to this invention and is formed in a configuration where a lever main portion 31F projects laterally from an outer circumferential surface of a disc portion 31E which is connected to the key operation transmission link 32. At a center of the disc portion 31E, a center hole 31C is formed to pass through the disc portion 31E. In addition, at one end surface of the disc portion 31E, a circular-shaped recessed portion 31B of which inner diameter is larger than the center hole 31C is formed to be recessed, and a pair of first fan-shaped protruding portions 31A, 31A is provided at an inner circumferential surface of the circular-shaped recessed portion 31B, at two positions that are away from each other by 180 degrees. An inner circumferential surface of each of the first fan-shaped protruding portions 31A is flush with an inner circumferential surface of the center hole 31C. In addition, both lateral surfaces of each of the first fan-shaped protruding portions 31A correspond to a pair of first movable contact portions 31T, 31T related to this invention, and are so configured that a line, on which the both lateral surfaces of the first fan-shaped protruding portions 31A intersect with each other in a case where the both lateral surfaces are extended, coincides with the center line of the torque transmission shaft 32A. Then, the distal end shaft 32F passes through the center hole 31C and the lock protrusions 32D are locked at a front-side end surface of the disc portion 31E, and the second fan-shaped protruding portions 32C and the first fan-shaped protruding portions 31A are assembled on each other in a state where the second fan-shaped protruding portions 32C and the first fan-shaped protruding portions 31A are arranged alternately with each other around the distal end shaft 32F as shown in FIG. 10.

The relay lever 31 is connected to the active lever 25 by means of the lever connecting member 30. Specifically, one end portion of the lever connecting member 30 is rotatably connected to a connecting shaft body 30K provided at a distal end of the lever main portion 31F of the relay lever 31, whereas the other end portion of the lever connecting member 30 is rotatably connected to a connecting shaft body 30J provided at the second fan-shaped protruding piece 25D of the active lever 25. Thus, the relay lever 31 rotates in a cooperating manner with the active lever 25, and the relay lever 31 is positioned at the lock position in a case where the active lever 25 is positioned at the lock position as shown in FIG. 11, and the relay lever 31 is positioned at the unlock position in a case where the active lever 25 is positioned at the unlock position as shown in FIG. 10.

On the other hand, the above-described key operation transmission link 32 rotates in a cooperating manner with the key cylinder 102, the key operation transmission link 32 is positioned at the key lock position in a case where the key operation is performed and the key cylinder 102 is at the key lock position, and the key operation transmission link 32 is positioned at the key unlock position in a case where the key operation is performed and the key cylinder 102 is at the key unlock position. In addition, the key cylinder 102 is normally positioned at a neutral position which is located intermediately between the key lock position and the key unlock position, and in cooperation with this, also the key operation transmission link 32 is normally positioned at a neutral position which is positioned intermediately between the key lock position and the key unlock position.

Then, when the relay lever 31 is positioned at the unlock position together with the active lever 25 in a state where the key operation transmission link 32 is positioned at the neutral position, a relatively large rotation clearance SP is formed between each of the first fan-shaped protruding portions 31A and the second fan-shaped protruding portion 32C which is adjacent to the first fan-shaped protruding portion 31A in the counter-clockwise direction as shown in FIG. 10. Thus, in a case where the relay lever 31 rotates in the counter-clockwise direction towards the lock position as indicated in a change from FIG. 10 to FIG. 11, the first fan-shaped protruding portions 31A rotate within a range of the rotation clearance SP formed between the first fan-shaped protruding portions 31A and the second fan-shaped protruding portions 32C. In addition, when the relay lever 31 is positioned at the lock position together with the active lever 25 in a state where the key operation transmission link 32 is positioned at the neutral position, the relatively large rotation clearance SP is formed between each of the first fan-shaped protruding portions 31A and the second fan-shaped protruding portion 32C which is adjacent to the first fan-shaped protruding portion 31A in the clockwise direction as shown in FIG. 11. Thus, in a case where the relay lever 31 rotates in the clockwise direction towards the lock position as indicated in the change from FIG. 11 to FIG. 10, the first fan-shaped protruding portions 31A rotate within the range of the rotation clearance SP formed between the first fan-shaped protruding portions 31A and the second fan-shaped protruding portions 32C. In this way, the transmission of the force from the relay lever 31 to the key operation transmission link 32 is interrupted, and the key cylinder 102 is kept at the neutral position unless the key operation is performed.

On the other hand, when the key operation transmission link 32 is rotated from the neutral position to the key lock position in a state where the relay lever 31 is positioned at the unlock position together with the active lever 25 as shown in FIG. 10, the second fan-shaped protruding portions 32C rotate in the counter-clockwise direction in this drawing beyond the clearance SP formed between the second fan-shaped protruding portions 32C and the first fan-shaped protruding portions 31A, and the second movable contact portion 32T, which is the lateral surface facing the counter-clockwise direction in this drawing, of each of the second fan-shaped protruding portions 32C is in surface-contact with the first movable contact portion 31T, which is the lateral surface facing the clockwise direction, of each of the first fan-shaped protruding portions 31A, and the second movable contact portion 32T make the relay lever 31 together with the active lever 25 to move to the lock position shown in FIG. 11. In addition, when the key operation transmission link 32 is rotated from the neutral position to the key unlock position in a state where the relay lever 31 is positioned at the lock position together with the active lever 25 as shown in FIG. 11, the second fan-shaped protruding portions 32C rotate in the clockwise direction in this drawing beyond the clearance SP formed between the second fan-shaped protruding portions 32C and the first fan-shaped protruding portions 31A, and the second movable contact portion 32T, which is the lateral surface facing the clockwise direction in this drawing, of each of the second fan-shaped protruding portions 32C is in surface-contact with the first movable contact portion 31T, which is the lateral surface facing the counter-clockwise direction, of each of the first fan-shaped protruding portions 31A, and thus the second movable contact portions 32T make the relay lever 31 together with the active lever 25 to move to the unlock position shown in FIG. 10. In this way, a key operation force is transmitted from the key operation transmission link 32 to the relay lever 31, and the active lever 25, together with the relay lever 31, can be switched to the lock position and to the unlock position by means of the key operation relative to the key cylinder 102 shown in FIG. 2A.

Thus, according to the door locking device 10 of this embodiment, the key operation transmission link 32, which transmits the key operation force applied relative to the key cylinder 102 to the relay lever 31 serving as "the lock switch member" related to this invention, is arranged so as to rotate about a common rotation axis J1 (see FIG. 6, FIG. 7, FIG. 10 and FIG. 11) which is shared with the relay lever 31, and therefore it is possible to reduce size of the door locking device 10 compared to a conventional device at which the relay lever 31 and the key operation transmission link 32 are arranged so as to rotate about different rotation axes from each other. In addition, the first fan-shaped protruding portions 31A including the first movable contact portions 31T for transmitting the force to the key operation transmission link 32 and the relay lever 31, and the second fan-shaped protruding portions 32C including the second movable contact portions 32T for transmitting the force to the key operation transmission link 32 and the relay lever 31 are arranged around the common rotation axis J1 that is common between the key operation transmission link 32 and the relay lever 31, and thus a rotation space for the first and second movable contact portions 31T, 32T fits within a circular-shaped area around the common rotation axis J1. Also in this respect, it is possible to reduce the size of the door locking device 10.

Further, according to the door locking device 10 of this embodiment, in order to transmit the force of the key operation from the key operation transmission link 32 to the relay lever 31, the pair of first movable contact portions 31T, 31T and the pair of second movable contact portions 32T, 32T are in surface-contact with each other, and therefore a load applied to the first and second movable contact portions 31T, 32T is reduced and durability improves compared to a device at which only a single first movable contact portion 31T and a single second movable contact portion 32T are in surface-contact with each other, and compared to a device at which the first and second movable contact portions 31T, 32T are in point-contact or in line-contact with each other.

Second Embodiment

Figure 13:
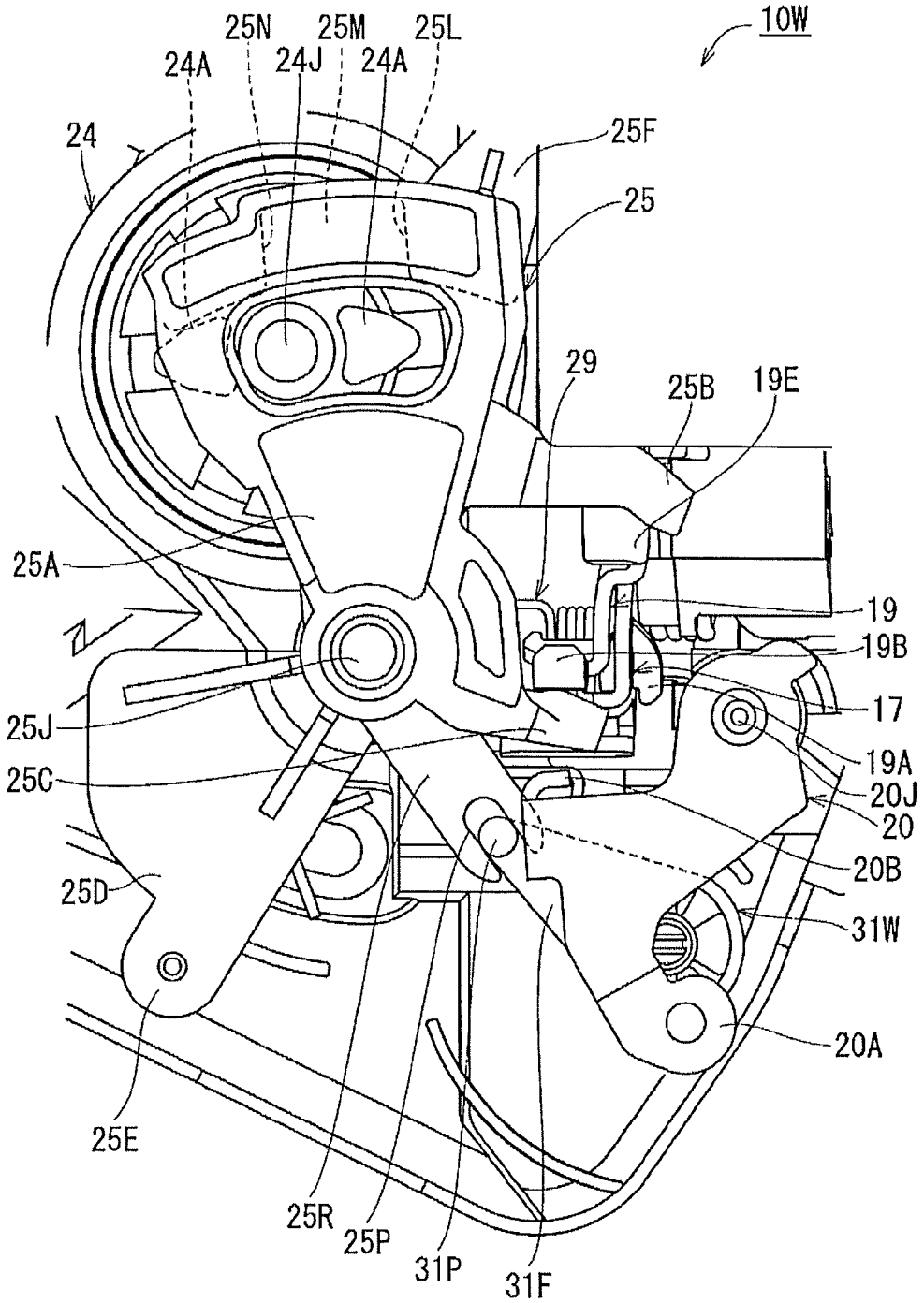
Figure 14:
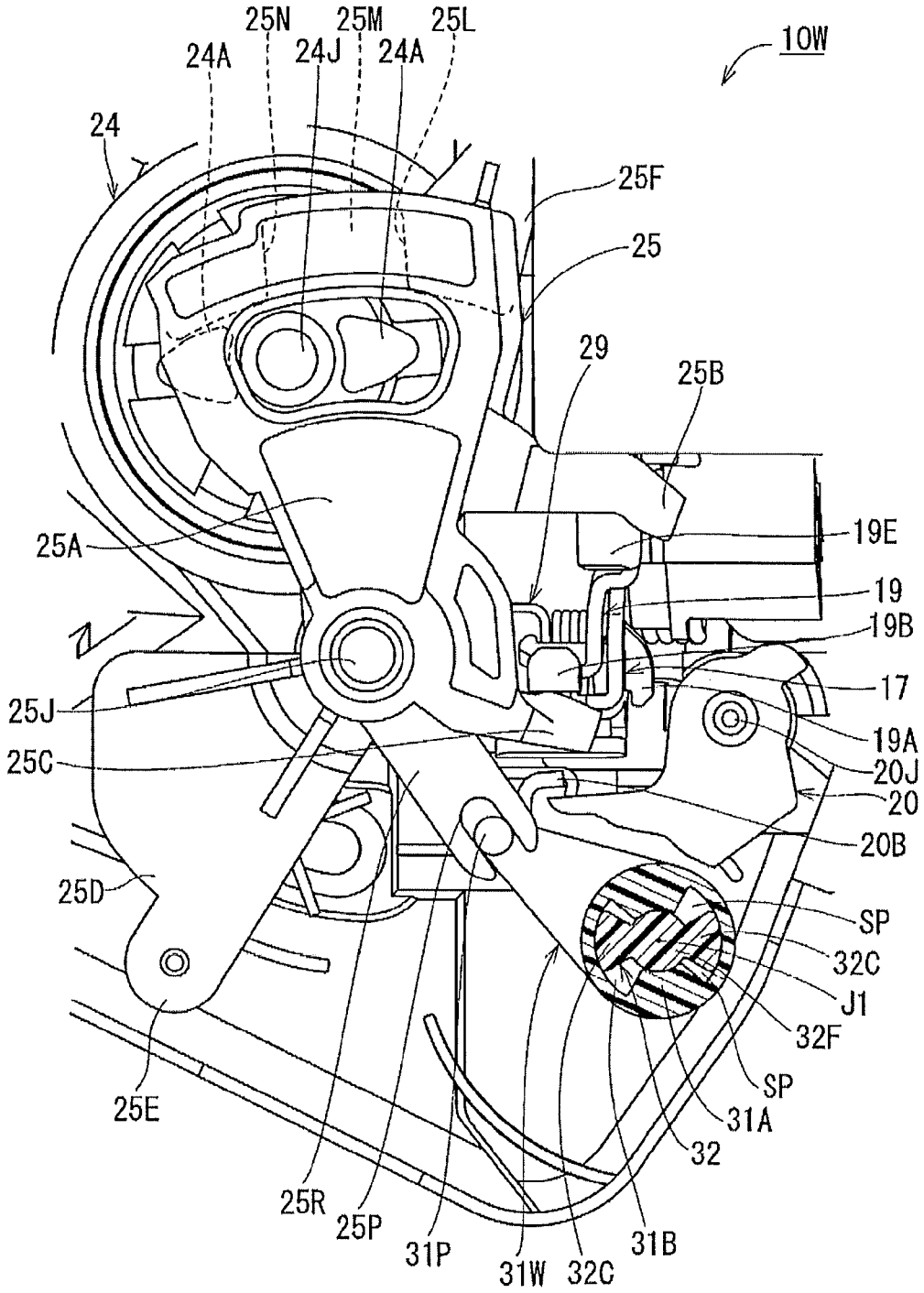
Figure 15:
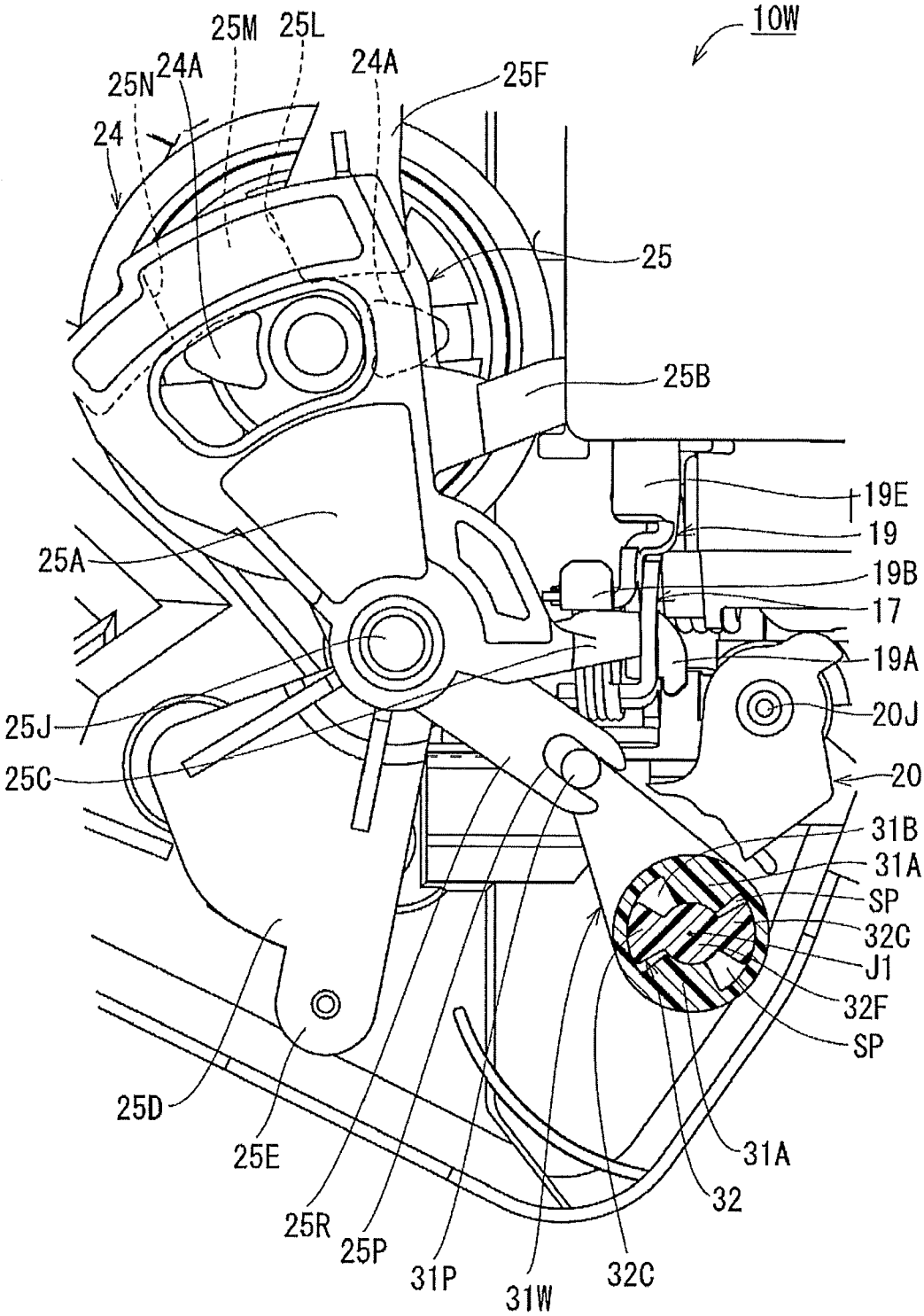

A door locking device 10W of this embodiment is shown in FIG. 13 to FIG. 15. In the first embodiment, the relay lever 31 corresponding to "the lock switch member" related to this invention is connected relative to the active lever 25 by means of the lever connecting member 30, however, according to the door locking device 10W of this embodiment, as shown in FIG. 13, a pin 31P is provided at the distal end of the lever main portion 31F of a relay lever 31W corresponding to "the lock switch member" related to this invention, and it is configured that the pin 31P engages with a long hole 25P provided at a connecting arm 25R extending from the active lever 25 towards the relay lever 31W. The long hole 25P extends in a direction that is orthogonal to a rotation center of the active lever 25, and one end portion of the long hole 25P opens toward a distal end of the connecting arm 25R. Other configurations are same as those of the first embodiment, and therefore identical numerical designations are given to portions that are identical to the first embodiment, and duplicate descriptions are omitted.

According also to the door locking device 10W of this embodiment, the same effects to those of the door locking device 10 of the first embodiment are obtained. In addition, the door locking device 10 of the first embodiment is so configured that in a case where the key operation transmission link 32 rotates in the clockwise direction, the active lever 25 also rotates in the clockwise direction, and in a case where the key operation transmission link 32 rotates in the counter-clockwise direction, the active lever 25 also rotates in the counter-clockwise direction, however, according to the door locking device 10W of this embodiment, in a case where the key operation transmission link 32 rotates in the clockwise direction, the active lever 25 rotates in the counter-clockwise direction as indicated in a change from FIG. 14 to FIG. 15, and in a case where the key operation transmission link 32 rotated in the counter-clockwise direction, the active lever 25 rotates in the clockwise direction as indicated in the change from FIG. 15 to FIG. 14. Thus, by assembling the door locking device 10W of this embodiment on the door 101 instead of assembling the door locking device 10 of the first embodiment, the configuration may be changed so that, for example, in a case where a connecting member, which connects the key operation transmission link 32 and the key cylinder 102 (see FIG. 2A) with each other, brings the door locking device 10 of the first embodiment into the locked state by pulling, the door locking device 10W of this embodiment is brought into the unlocked state by pulling the connecting member which connects the key operation transmission link 32 and the key cylinder 102 with each other.

Third Embodiment

A door locking device 10V of this embodiment is shown in FIG. 16 to FIG. 23. Only a configuration of the door locking device 10V, which differs from the configuration of the door locking device 10 of the first embodiment, will be described hereunder.

Figure 16:
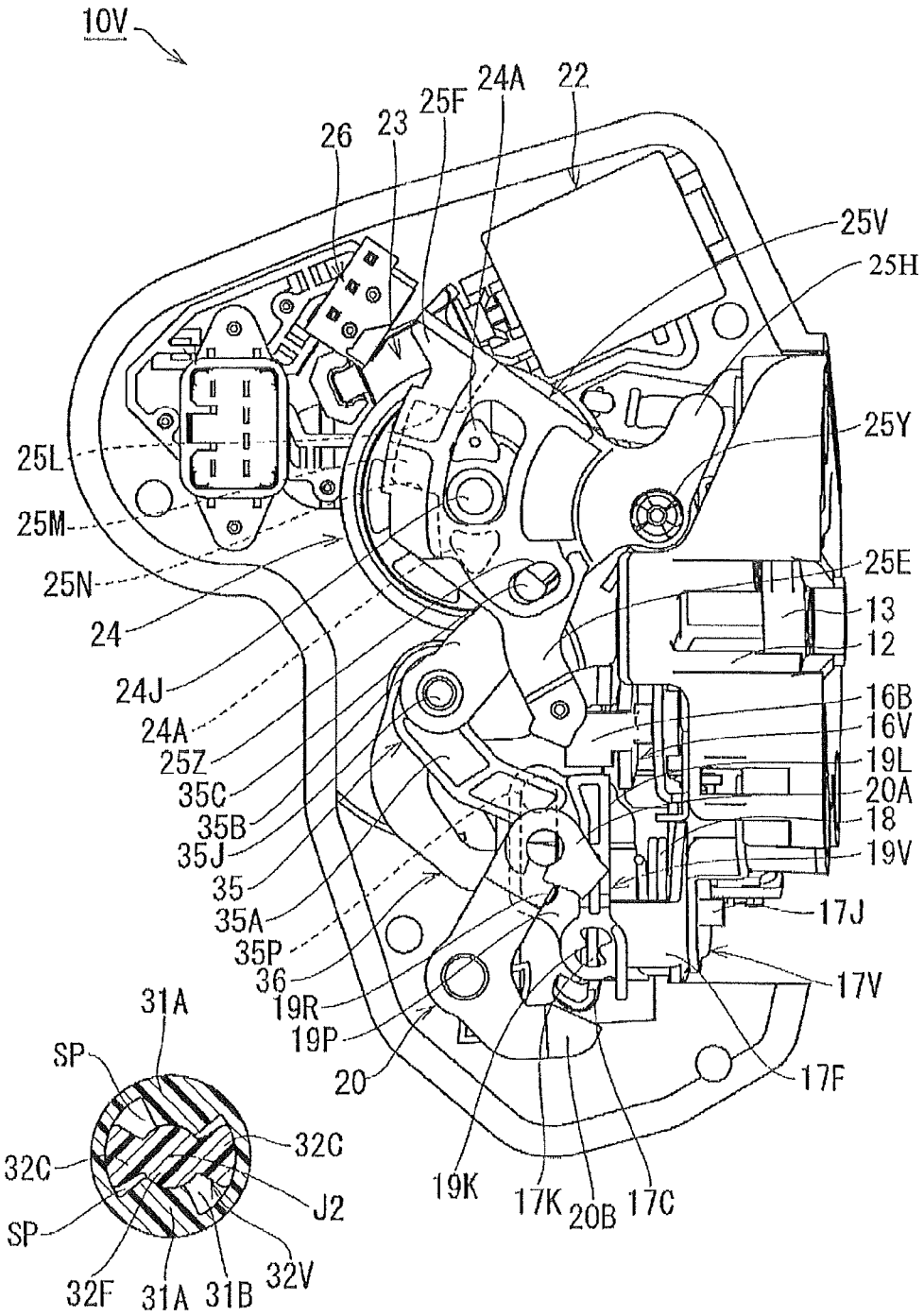
Figure 17:
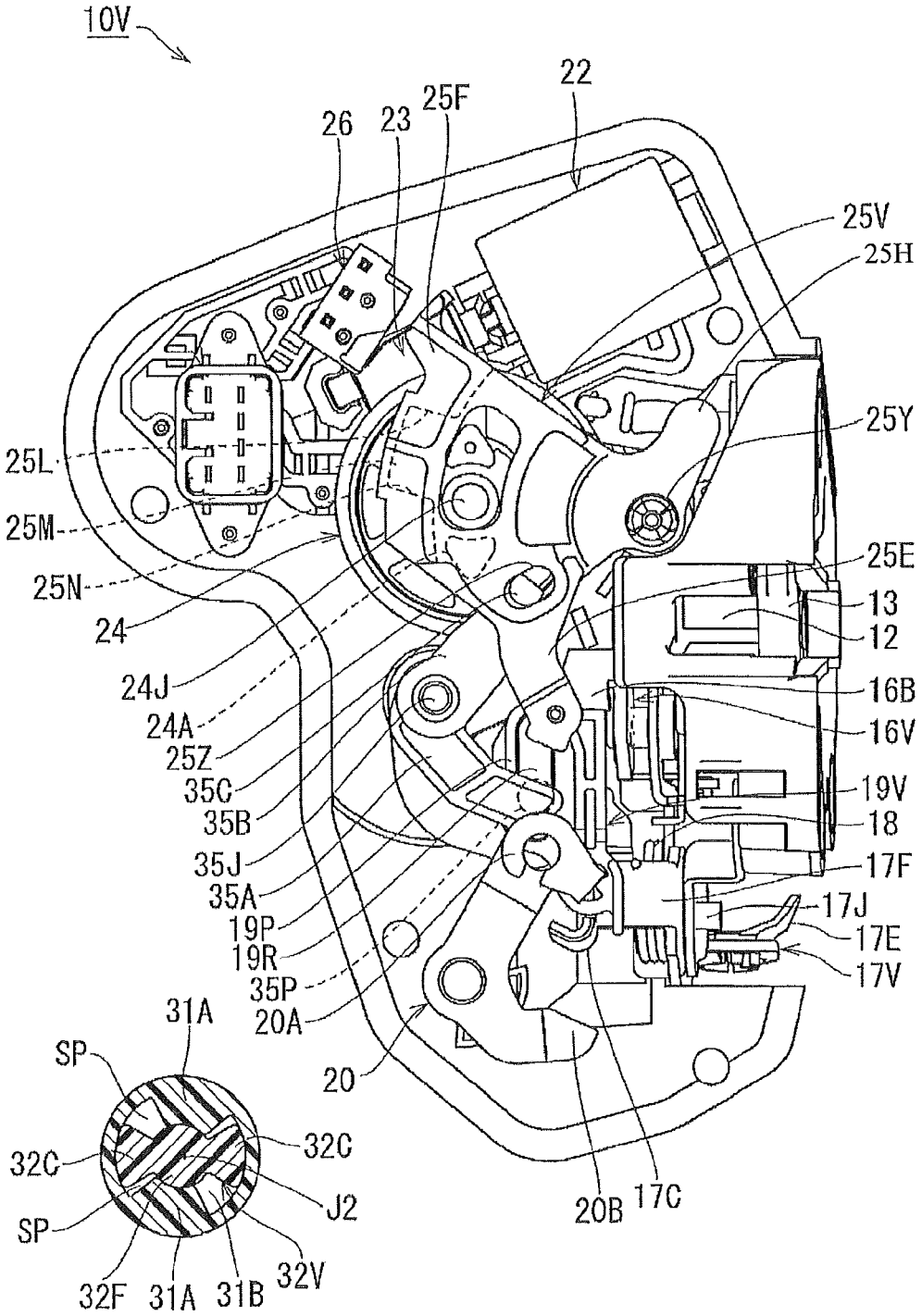

According to the configuration of the door locking device 10 of the first embodiment, as shown in FIG. 4A and FIG. 4B, the open link 19 rotates about the rotation axis that is parallel to the rotation axes of the latch 13 and of the ratchet 14, and the operation arm 25C of the active lever 25 is in contact with the lock-release piece 19B of the open link 19, however, according to the configuration of the door locking device 10V of this embodiment, as shown in FIG. 16, an open link 19V rotates about a rotation axis that is substantially parallel to a rotation axis of an active lever 25V, and the active lever 25V is connected via a lock link 35 to the open link 19V.

Specifically, by bending a front end portion of an outside open lever 17V of this embodiment at right angles in the axial direction of the outside open lever rotation axis body 17J, a front end bent piece 17F is formed at the outside open lever 17V, and an engagement protruding piece 17K is protrudingly formed at the front end bent piece 17F so as to protrude in a direction away from the outside open lever rotation axis body 17J. On the other hand, an engagement hole 19K including an identical configuration to that of the engagement hole 17B (see FIG. 4A) provided at the outside open lever 17 of the first embodiment is formed at a lower end portion of the open link 19V, the engagement protruding piece 17K of the outside open lever 17 is inserted through the engagement hole 19K, and thus the open link 19V is configured to rotate about the rotation axis that is substantially parallel to the rotation axis of the active lever 25V.

The open link 19V is provided with a link main portion 19L extending upwardly from the engagement protruding piece 17K and is provided with a connection piece 19P projecting from the link main portion 19L laterally towards the left side in FIG. 16. In addition, a long hole 19R extending substantially parallelly to the link main portion 19L is formed at the connection piece 19P. Then, the open link 19V moves between the unlock position (see FIG. 16 and FIG. 17) at which the link main portion 19L extends vertically above the engagement protruding piece 17K and the lock position (see FIG. 18 and FIG. 19) at which the link main portion 19L is inclined from the unlock position toward the left side in FIG. 16 and in FIG. 17.

As shown in FIG. 16, the lock link 35 rotates about a lock link rotation axis body 35J provided obliquely below the active lever 25V, and is provided with a first engagement arm 35A extending from the lock link rotation axis body 35J obliquely downwardly towards the open link 19V and a second engagement arm 35B extending obliquely upwardly from the lock link rotation axis body 35J towards the active lever 25V. Then, a second engagement pin 35C provided at a distal end of the second engagement arm 35B engages with a long hole 25Z formed at the active lever 25V, whereas a first engagement pin 35P provided at a distal end of the first engagement arm 35A engages with the long hole 19R of the open link 19V. In addition, the long hole 25Z extends along a line that is orthogonal to a rotation center of the active lever 25V. Thus, the active lever 25V, the lock link 35 and the open link 19V rotate in cooperation with one another. In a case where the active lever 25V is positioned at the lock position, also the open link 19V is positioned at the lock position, and in a case where the active lever 25V is positioned at the unlock position, also the open link 19V is positioned at the unlock position.

Figure 18:
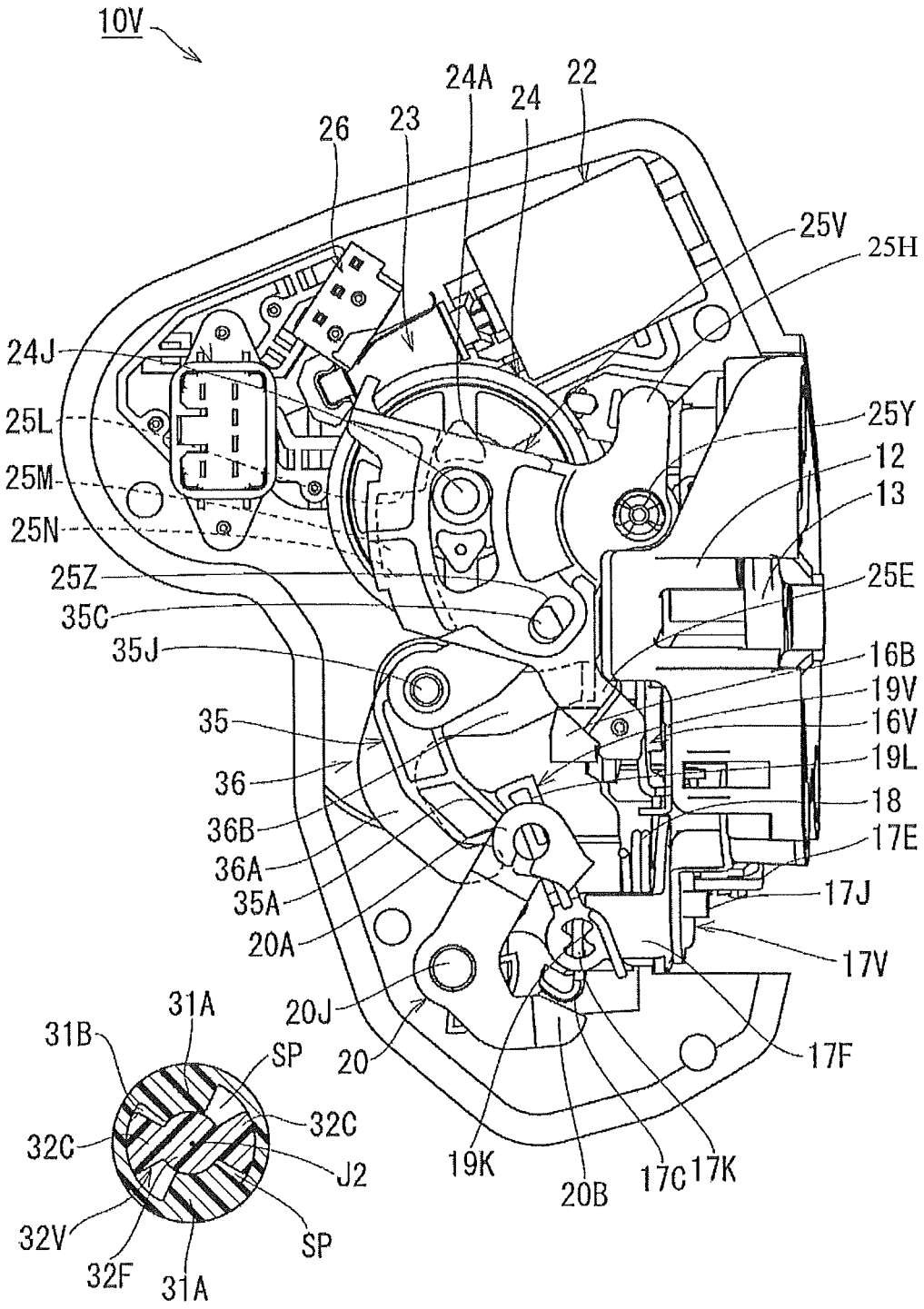
Figure 19:
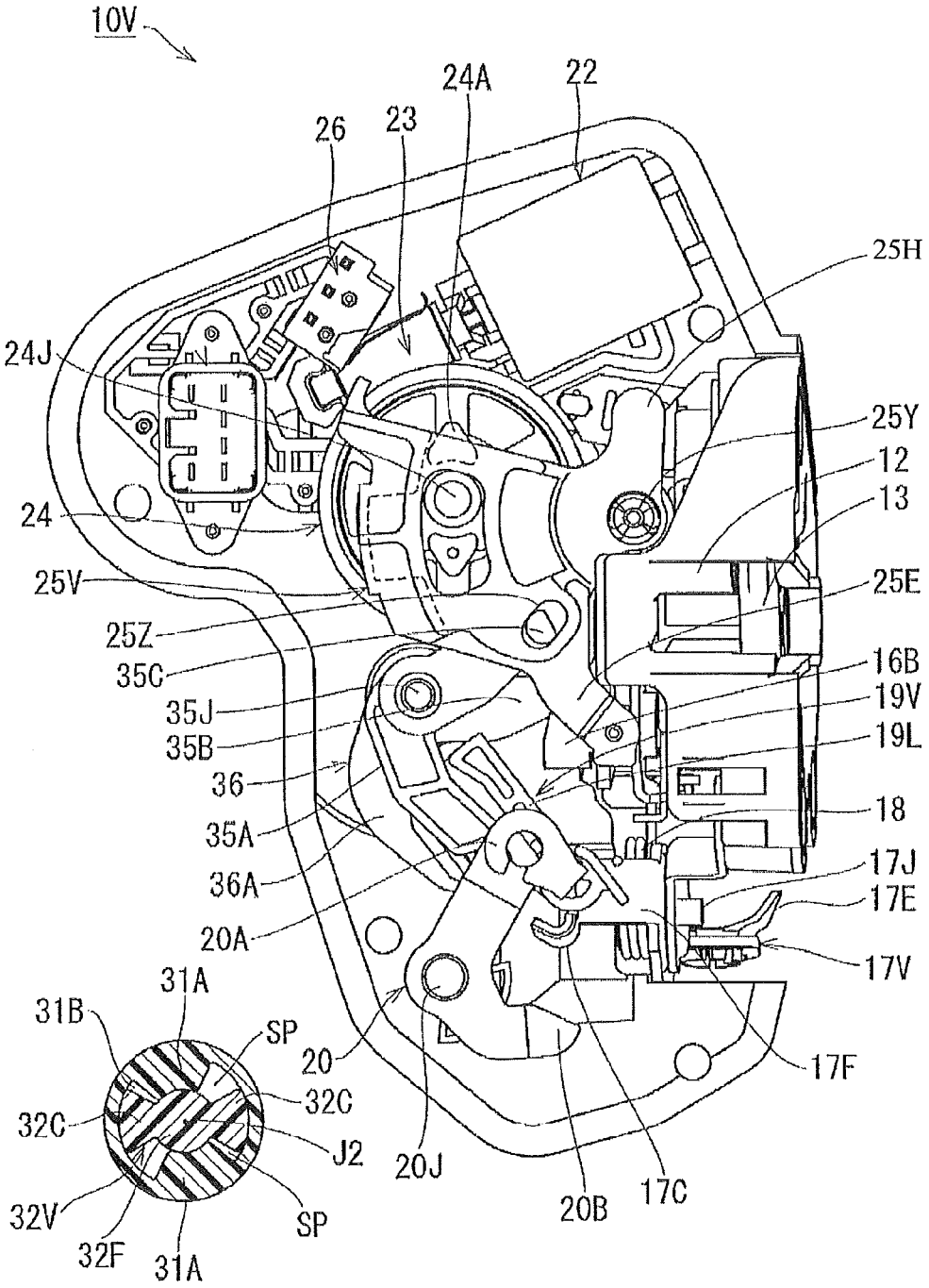

A lift lever 16V of this embodiment is provided with a distal end contact portion 16B in a manner that the distal end contact portion 16B is positioned directly above the link main portion 19L of the open link 19V at the unlock position. In addition, a cancel link 36 is rotatably supported by the lock link rotation axis body 35J together with the lock link 35. The cancel link 36 is, as shown in FIG. 18, provided with a driven lever 36B extending from the lock link rotation axis body 35J to a position above the distal end contact portion 16B of the lift lever 16V, and a push lever 36A extending from the lock link rotation axis body 35J to a left side position relative to the link main portion 19L of the open link 19V.

Then, when the door is closed in a state where the open link 19V is positioned at the lock position, in the closing process of the door, the driven lever 36B of the cancel link 36 is pushed up by the lift lever 16V rotating together with the ratchet 14 (see FIG. 3B), the cancel link 36 rotates, and the open link 19V is pushed by the push lever 36A and thus moves to the unlock position. That is, similarly to the door locking device 10 of the first embodiment, also the door locking device 10V of this embodiment is provided with the cancellation function.

Figure 21:
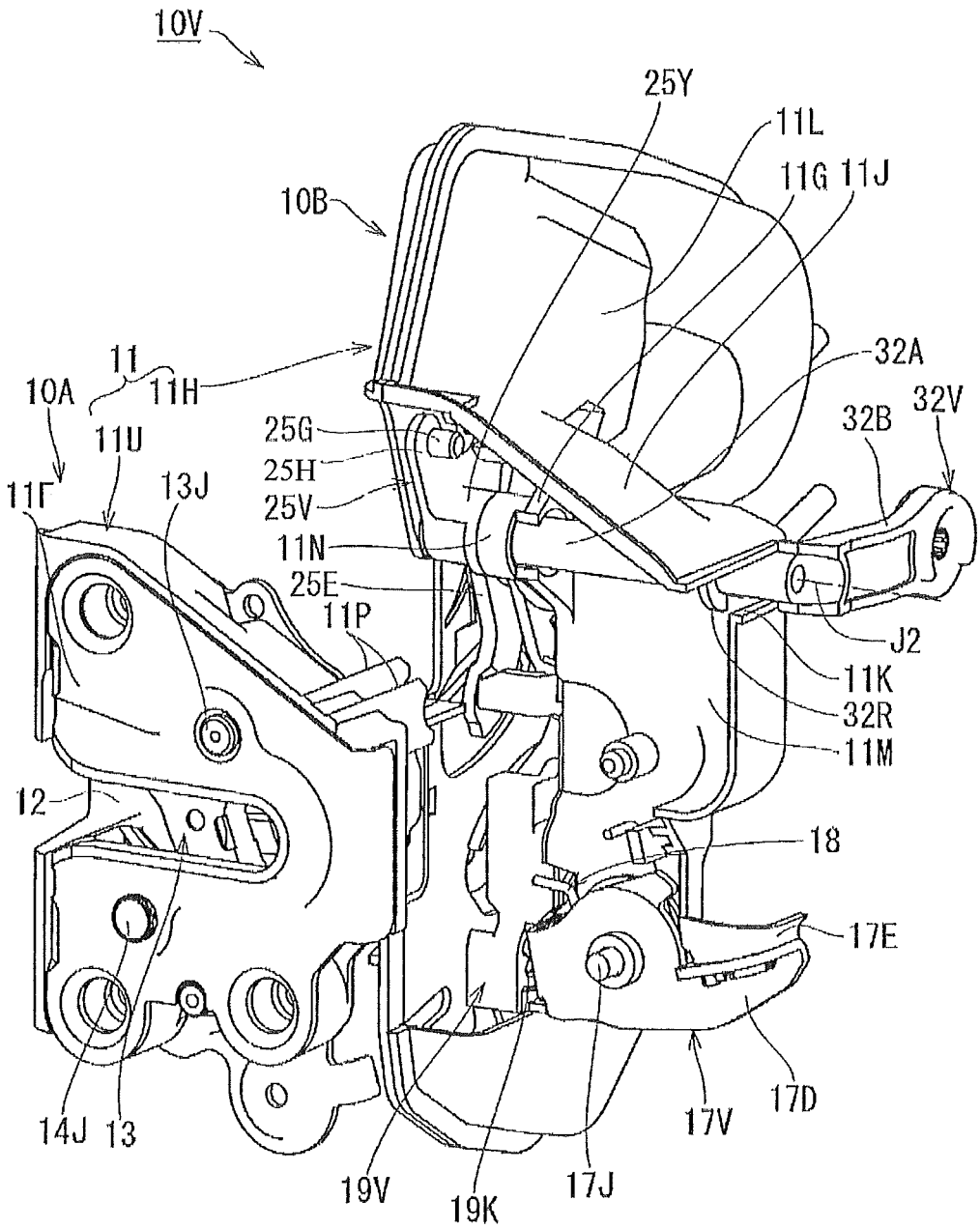

The active lever 25V of this embodiment is provided with a positioning connecting arm 25H projecting obliquely upwardly, and the positioning support column 25G is protrudingly formed at a reverse surface of the positioning connecting arm 25R as shown in FIG. 21. Then, the positioning support column 25G engages with the special-shaped spring 27 (see FIG. 7) described in the first embodiment, and the active lever 25V is configured to be kept at the lock position and the unlock position.

Figure 22:
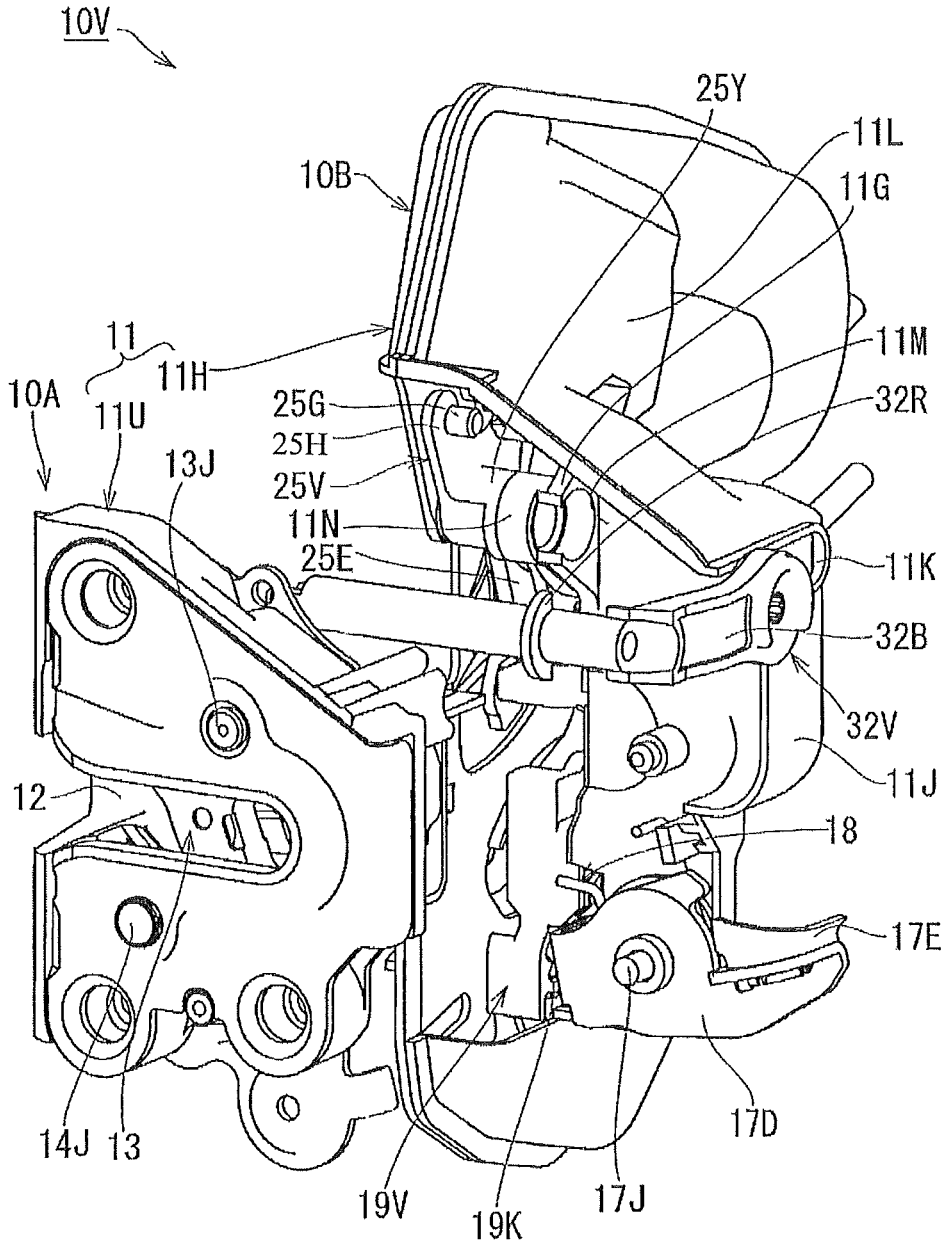

As shown in FIG. 22, the door locking device 10V of this embodiment is can be divided into the latch unit 10A including the latch 13, the ratchet 14 and the lift lever 16V (see FIG. 16) which are rotatably supported at the latch unit 10A, and a main body unit 10B including others than the latch 13 and the like, that is, including the active lever 25V, the inside open lever 20 and the like which are rotatably supported at the main body unit 10B. Specifically, a lateral wall portion 11U of the support body 11 is divided from a body main portion 11H of the support body 11, and the lateral wall portion 11U includes the base wall 11C (see FIG. 3A) rotatably supporting the latch 13 and the like. In addition, at the body main portion 11H, a main body rear surface protruding wall 11M protrudes from a rear surface of a main wall 11L supporting the rotation axes of the worm wheel 24, the inside open lever 20, the lock link 35 and the like, and a fitting wall 11J protrudes from an outer edge portion of the main body rear surface protruding wall 11M towards the lateral wall portion 11U.

In addition, a support portion 11G protrudes from an edge portion at a front side of the main body rear surface protruding wall 11M, and a support ring 11N formed in a cylindrical shape is formed at the support portion 11G. Then, one end of a rotation cylinder axis 25Y, which is formed in a cylindrical shape and is provided at the active lever 25V, is inserted inside the support ring 11N and is rotatably supported thereat.

Figure 20:
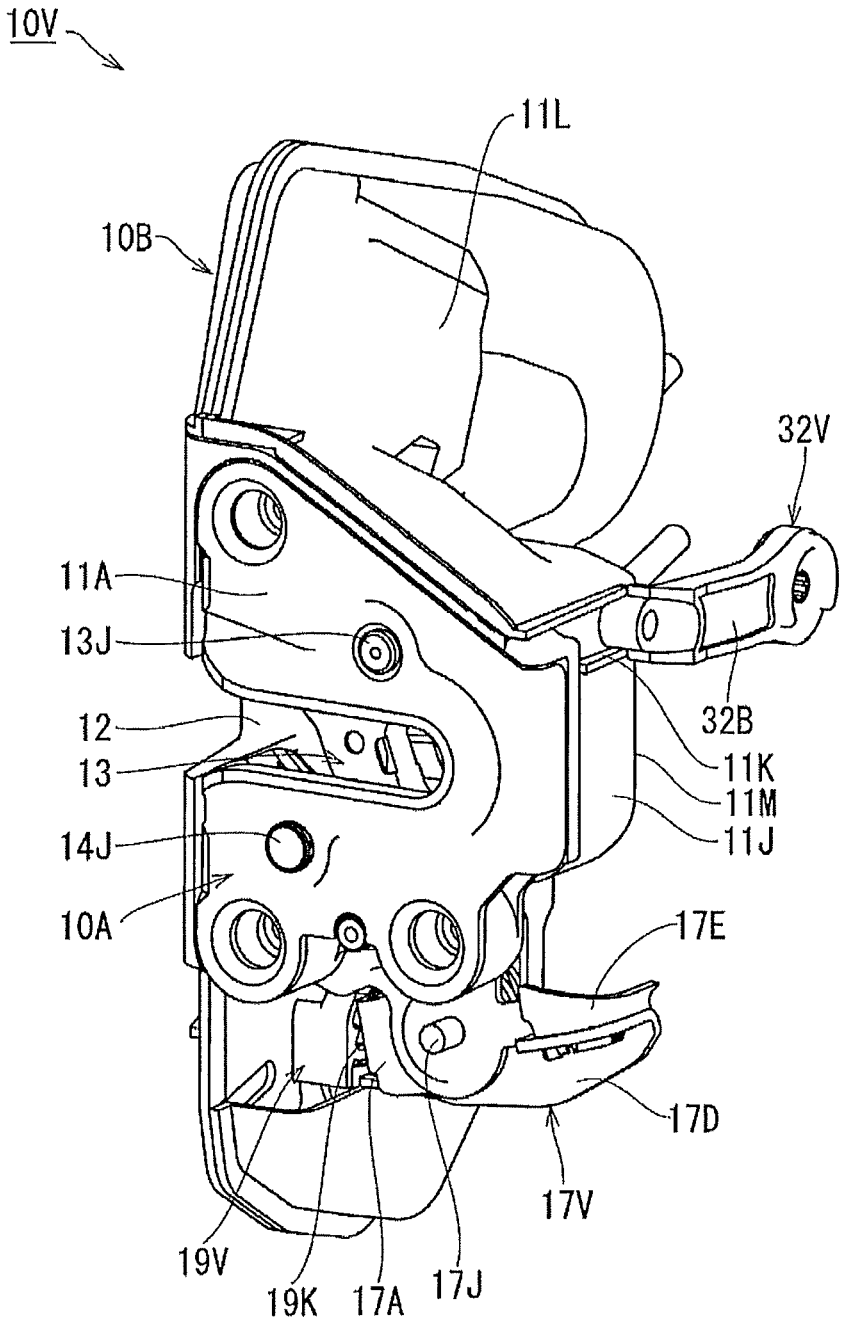
Figure 23:
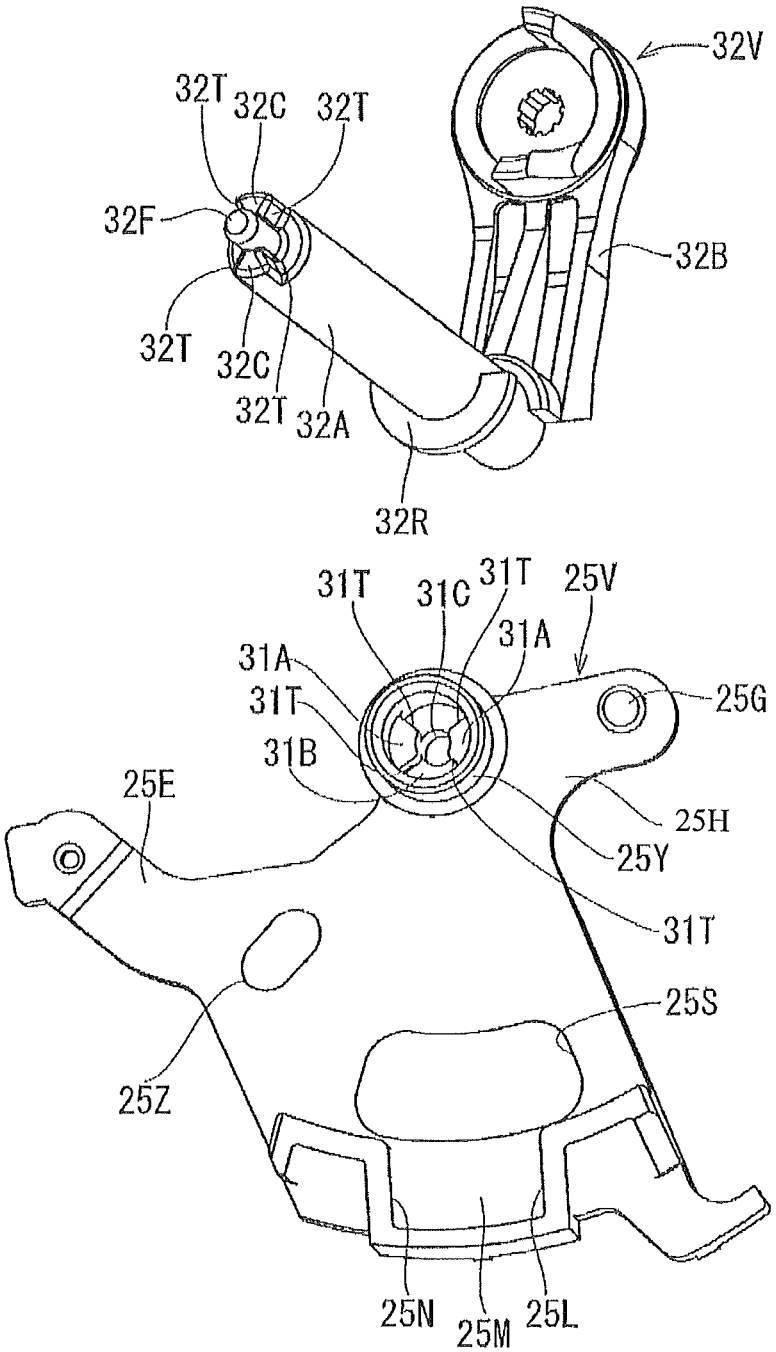
Figure 24:
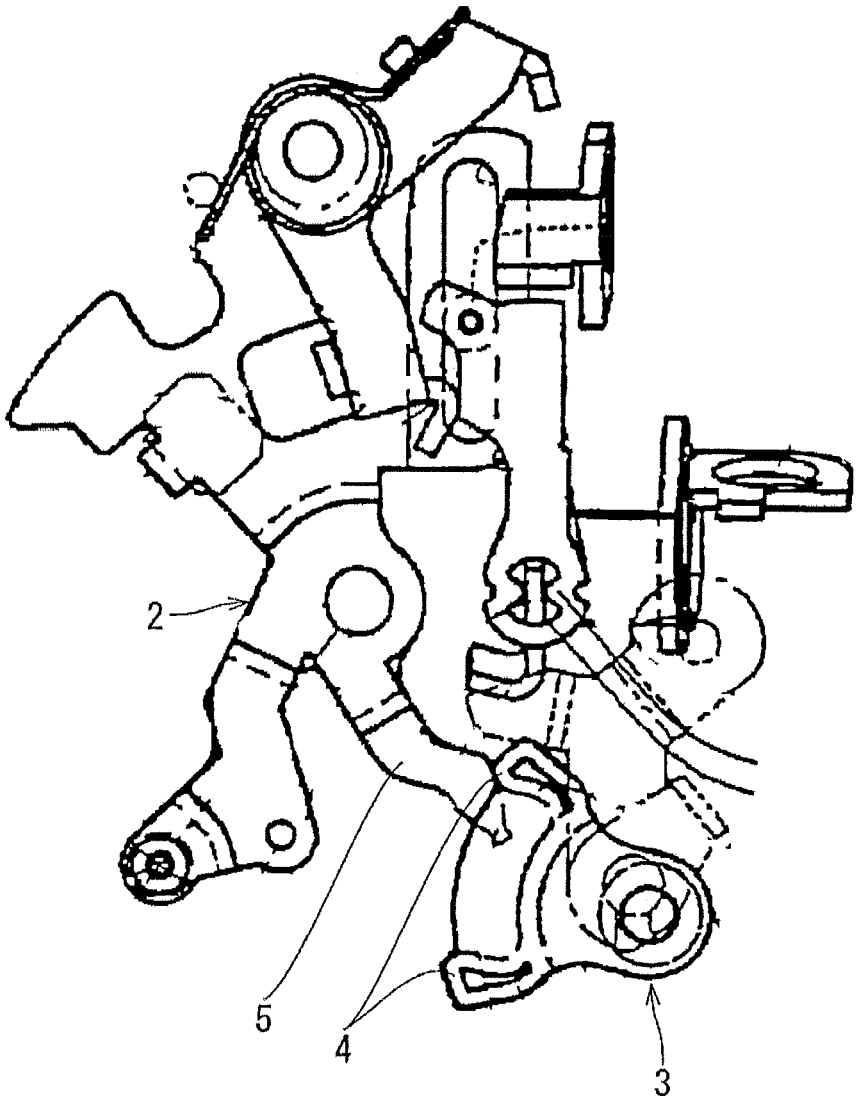

In addition, a letter-U-groove 11K is formed at a portion of the fitting wall 11J, the portion which intersects with a central axis of the support ring 11N in a case where the central axis is extended. Then, as shown in FIG. 21, in a state where the lateral wall portion 11U and the body main portion 11H are separated from each other, a distal end portion of the torque transmission shaft 32A of the key operation transmission link 32V is inserted in the support ring 11N, and a rear end portion of the torque transmission shaft 32A is received by the letter-U-groove 11K from a lateral side and is rotatably supported thereat. In this state, as shown in FIG. 20, the latch unit 10A is fitted in an inside of the fitting wall 11J, and is fixed at the body main portion 11H by means of a screw that is not shown in the drawing. As shown in FIG. 23, a flange 32R formed in a semicircular configuration projects from a portion of the torque transmission shaft 32A of the key operation transmission link 32V, the portion which is closer to a rear end of the torque transmission shaft 32A, towards the latch unit 10A. The flange 32R is interposed between holding walls 11P, 11P (see FIG. 21), which are provided at the lateral wall portion 11U, from front and rear directions, and thereby the key operation transmission link 32V is supported so as not to move forward or backward in an axial direction.

In this embodiment, the above-described active lever 25V corresponds to "the lock switch member" related to this invention, and the key operation transmission link 32V is connected to the active lever 25V. For the connection thereof, as shown in FIG. 23, the rotation cylinder axis 25Y of the active lever 25V is provided with the center hole 31C, the circular-shaped recessed portion 31B and the first fan-shaped protruding portions 31A, 31A, in a similar manner to the disc portion 31E of the relay lever 31 of the first embodiment. Then, as shown at the left bottom in FIG. 16, the distal end shaft 32F of the key operation transmission link 32V is in a state of being inserted in the center hole 31C of the active lever 25V, and the first fan-shaped protruding portions 31A and the second fan-shaped protruding portions 32C are in a state of being arranged alternately with each other around the distal end shaft 32F. At the left bottom in each of FIG. 16 to FIG. 19, a positional relationship of the first fan-shaped protruding portions 31A and the second fan-shaped protruding portions 32C with each other, which corresponds to the state of the door locking device 10V indicated in each drawing, is enlarged and shown.

With the above-described configuration, in a similar manner to the door locking device 10 of the first embodiment, the door locking device 10V of this embodiment is also be able to transmit the force of the key operation, which is operated relative to the key cylinder, from the key operation transmission link 32V serving as "the key operation transmission member" to the active lever 25V serving as "the lock switch member". Then, because the active lever 25V and the key operation transmission link 32V rotate about a common rotation axis J2 (see FIG. 21), the door locking device 10V can be reduced in size in a similar manner to the door locking device 10 of the first embodiment.

Other Embodiment

This invention is not limited to the above-explained embodiments, and this invention may be modified variously within a scope without departing from a summary and may be implemented.

EXPLANATION OF REFERENCE NUMERALS

10, 10V, 10W door locking device
10A latch unit
19, 19V open link
22 motor (electric drive source)
25 active lever
25P long hole
25V active lever (lock switch member)
30 lever connecting member
31, 31W relay lever (lock switch member)
31A first fan-shaped protruding portion
31T first movable contact portion
31P pin
32, 32V key operation transmission link (key operation transmission member)
32C second fan-shaped protruding portion
32T second movable contact portion
100 vehicle
101 door
102 key cylinder
106 lock operation portion
J1, J2 rotation axis
SP rotation clearance
W2 wire (wire-shaped member)

The invention claimed is:

1. A door locking device, comprising:

a lock switch member adapted to be built in a door of a vehicle, and adapted to rotate between a lock position locking the door and an unlock position unlocking the door when receiving a force from a lock operation portion provided at a vehicle interior side of the door or from an electric drive source built in the door; a key operation transmission member provided to be rotatable about a common rotation axis which is shared with the lock switch member, the key operation transmission member adapted to rotate between a key lock position and a key unlock position when receiving a key operation force relative to a key cylinder provided at the door;

a pair of first fan-shaped protruding portions rotating integrally with a first member corresponding to one of the lock switch member and the key operation transmission member, and provided at two positions which are away from each other by 180 degrees around the common rotation axis thereof;

a pair of second fan-shaped protruding portions rotating integrally with a second member corresponding to the other one of the lock switch member and the key operation transmission member, the pair of second fan-shaped protruding portions being provided at two positions which are away from each other by 180 degrees around the common rotation axis thereof and arranged alternately with the first fan-shaped protruding portions around the common rotation axis thereof, the second fan-shaped protruding portions transmitting the key operation force between the second fan-shaped protruding portions and the first fan-shaped protruding portions in a case where the key operation transmission member is rotated to the key lock position, so that the lock switch member is rotated to the lock position in a cooperating manner, the second fan-shaped protruding portions transmitting the key operation force between the second fan-shaped protruding portions and the first fan-shaped protruding portions in a case where the key operation transmission member is rotated to the key unlock position, so that the lock switch member is rotated to the unlock position in the cooperating manner;

a rotation clearance provided between the first fan-shaped protruding portions and the second fan-shaped protruding portions around the common rotation axis, the rotation clearance causing only one of the first fan-shaped protruding portions and the second fan-shaped protruding portions to rotate together with the lock switch member, and restricting the key operation transmission member from rotating in the cooperating manner in a case where the lock switch member is rotated to the lock position and to the unlock position in a state where the key operation transmission member is positioned at a neutral position which is positioned intermediately between the key lock position and the key unlock position;

a torque transmission shaft provided at the second member and extending in an axial direction of the common rotation axis, the torque transmission shaft including the pair of second fan-shaped protruding portions at a distal end surface and including a circular-shaped outer circumferential surface which is flush with an outer circumferential surface of the pair of second fan-shaped protruding portions;

a circular-shaped recessed portion formed to be recessed at the first member, the circular-shaped recessed portion including a circular-shaped inner circumferential surface, the pair of first fan-shaped protruding portions protruding from part of the circular-shaped inner circumferential surface, the circular-shaped recessed portion receiving the pair of second fan-shaped protruding portions;

a center hole formed at a center of an inner-most wall of the circular-shaped recessed portion so as to pass therethrough;

a distal end shaft protruding from a center of the distal end surface of the torque transmission shaft farther than the pair of second fan-shaped protruding portions and passing through the center hole;

a lock protrusion protruding laterally from a distal end portion of the distal end shaft, being locked at an outer side opening edge of the center hole and restricting the distal end shaft from coming off the center hole;

a support cylinder rotatably supporting an intermediate portion of the torque transmission shaft in an axial direction thereof; and a large diameter portion at which a diameter of a base end portion of the torque transmission shaft is, increased in a stepped configuration, the large diameter portion facing the first member with interposing the support cylinder between the large diameter portion and the first member in the axial direction of the common rotation axis.

2. The door locking device according to claim 1, comprising:

a stopper at which a part, which is around the common rotation axis, of the support cylinder protrudes toward the large diameter portion; and a stopper contact protruding portion formed by protruding a part, which is around the common rotation axis, of the large diameter portion toward the support cylinder in a manner that the part protrudes at a position which differs from the stopper, the stopper contact protruding portion being in contact with the stopper in a case where the torque transmission shaft is beyond a normal range of rotation.

3. The door locking device according to claim 1, further comprising:

a latch unit adapted to be able to keep the door in a state where the door is closed relative to the vehicle;

an open link adapted to transfer to an unlock position where an engagement relative to the latch unit is possible and to a lock position where the engagement relative to the latch unit is impossible, the open link adapted to lock the door at the lock position, and on the other hand, to unlock the door at the unlock position;

an active lever defining the lock position and the unlock position of the open link;

a relay lever rotating about a rotation axis which is different from the active lever and serving as the lock switch member; and a lever connecting member connecting the active lever and the relay lever to each other so that the active lever and the relay lever are movable in a cooperating manner with each other.

4. The door locking device according to claim 1, further comprising:

a latch unit adapted to be able to keep the door in a state where the door is closed relative to the vehicle;

an open link adapted to transfer to an unlock position where an engagement relative to the latch unit is possible and to a lock position where the engagement relative to the latch unit is impossible, the open link adapted to lock the door at the lock position, and on the other hand, to unlock the door at the unlock position;

an active lever defining the lock position and the unlock position of the open link;

a relay lever rotating about a rotation axis which is different from the active lever and serving as the lock switch member;

a long hole provided at one of the active lever and the relay lever; and a pin provided at the other one of the active lever and the relay lever, the pin engaging with the long hole and enabling the active lever and the relay lever to move in the cooperating manner with each other.

5. The door locking device according to claim 4, further comprising:

the active lever adapted in a manner that a wire-shaped member operating integrally with the lock operation portion is connected to the active lever, the active lever rotating when receiving an operation force relative to the lock operation portion, rotating when receiving a power from a motor serving as the electric drive source, and moving between a lock position locking the door and an unlock position unlocking the door.

6. A door locking device, comprising:

a lock switch member adapted to be built in a door of a vehicle, and adapted to rotate between a lock position locking the door and an unlock position unlocking the door when receiving a force from a lock operation portion provided at a vehicle interior side of the door or from an electric drive source built in the door;

a key operation transmission member adapted to rotate between a key lock position and a key unlock position when receiving a key operation force relative to a key cylinder provided at the door, the key operation transmission member transmitting the key operation force to the lock switch member so that, in a case where the key operation transmission member rotates to the key lock position, the lock switch member is rotated to the lock position in a cooperating manner, whereas, in a case where the key operation transmission member rotates to the key unlock position, the lock switch member is rotated to the unlock position in the cooperating manner, the key operation transmission member arranged to rotate about a common rotation axis which is shared with the lock switch member;

a pair of first fan-shaped protruding portions rotating integrally with a first member corresponding to one of the lock switch member and the key operation transmission member, and provided at two positions which are away from each other by 180 degrees around the common rotation axis thereof; and a pair of second fan-shaped protruding portions rotating integrally with a second member corresponding to the other one of the lock switch member and the key operation transmission member, the pair of second fan-shaped protruding portions being provided at two positions which are away from each other by 180 degrees around the common rotation axis thereof and arranged alternately with the first fan-shaped protruding portions around the common rotation axis in a manner that a predetermined rotation clearance is interposed relative to the first fan-shaped protruding portions, the pair of second fan-shaped protruding portions transmitting the key operation force between the second fan-shaped protruding portions and the first fan-shaped protruding portions in a case where the key operation transmission member is rotated to the key lock position, so that the lock switch member is rotated to the lock position in a cooperating manner, the pair of second fan-shaped protruding portions transmitting the key operation force between the second fan-shaped protruding portions and the first fan-shaped protruding portions in a case where the key operation transmission member is rotated to the key unlock position, so that the lock switch member is rotated to the unlock position in the cooperating manner, wherein the first fan-shaped protruding portions rotate relative to the second fan-shaped protruding portions in a range of the rotation clearance between the first fan-shaped protruding portions and the second fan-shaped protruding portions, and a transmission of a force from the lock switch member to the key operation transmission member is configured to be interrupted even in a case where the lock switch member is rotated to any one of the lock position and the unlock position in a state where the key operation transmission member is positioned at a neutral position which is positioned intermediately between the key lock position and the key unlock position, whereas the second fan-shaped protruding portions rotate relative to the first fan-shaped protruding portions beyond the rotation clearance between the second fan-shaped protruding portions and the first fan-shaped protruding portions and thus the key operation force is configured to be transmitted from the key operation transmission member to the lock switch member in a case where the key operation transmission member is rotated from the neutral position to the key lock position and to the key unlock position, the door locking device further comprising:

a torque transmission shaft provided at the second member and extending in an axial direction of the common rotation axis, the torque transmission shaft including the pair of second fan-shaped protruding portions at a distal end surface and including a circular-shaped outer circumferential surface which is flush with an outer circumferential surface of the pair of second fan-shaped protruding portions;

a circular-shaped recessed portion formed to be recessed at the first member, the circular-shaped recessed portion including a circular-shaped inner circumferential surface, the pair of first fan-shaped protruding portions protruding from part of the circular-shaped inner circumferential surface, the circular-shaped recessed portion receiving the pair of second fan-shaped protruding portions;

a center hole formed at a center of an inner-most wall of the circular-shaped recessed portion so as to pass therethrough;

a distal end shaft protruding from a center of the distal end surface of the torque transmission shaft farther than the pair of second fan-shaped protruding portions and passing through the center hole;

a lock protrusion protruding laterally from a distal end portion of the distal end shaft, being locked at an outer side opening edge of the center hole and restricting the distal end shaft from coming off the center hole;

a support cylinder rotatably supporting an intermediate portion of the torque transmission shaft in an axial direction thereof; and a large diameter portion at which a diameter of a base end portion of the torque transmission shaft is increased in a stepped configuration, the large diameter portion facing the first member with interposing the support cylinder between the large diameter portion and the first member in the axial direction of the common rotation axis.

* * * * *